US012509840B2

(12) United States Patent
Boyce et al.

(10) Patent No.: US 12,509,840 B2
(45) Date of Patent: Dec. 30, 2025

(54) CEMENT FORM

(71) Applicant: Mono Slab EZ Form LLC, Island Park, ID (US)

(72) Inventors: Lance N. Boyce, Island Park, ID (US); Amber C. Boyce, Island Park, ID (US)

(73) Assignee: MONO SLAB EZ FORM LLC, Island Park, ID (US)

( * ) Notice: Subject to any disclaimer, the term of this patent is extended or adjusted under 35 U.S.C. 154(b) by 0 days.

(21) Appl. No.: 17/450,188

(22) Filed: Oct. 7, 2021

(65) Prior Publication Data

US 2022/0025604 A1 Jan. 27, 2022

Related U.S. Application Data

(60) Division of application No. 16/713,517, filed on Dec. 13, 2019, now abandoned, which is a division of application No. 15/967,259, filed on Apr. 30, 2018, now Pat. No. 10,538,893, which is a continuation of application No. 14/698,674, filed on Apr. 28, 2015, now Pat. No. 10,024,023.

(51) Int. Cl.
*E02D 27/01* (2006.01)
*E04G 17/14* (2006.01)

(52) U.S. Cl.
CPC ..... *E02D 27/013* (2013.01); *E02D 27/01* (2013.01); *E02D 27/016* (2013.01); *E04G 17/14* (2013.01)

(58) Field of Classification Search
CPC ..... E02D 27/013; E02D 27/01; E02D 27/016; E04G 17/14
See application file for complete search history.

(56) References Cited

U.S. PATENT DOCUMENTS 1,142,887 A 6/1915 Keenan
1,527,698 A 2/1925 Pearthree
1,682,008 A * 8/1928 Heltzel ..... E01C 19/502 160/25
1,944,511 A 1/1934 Heltzel
2,535,277 A 12/1950 Bernard
2,614,311 A 10/1952 Shook
2,678,482 A 5/1954 Cuthbertson et al.
2,835,017 A 5/1958 Hoerr
(Continued)

FOREIGN PATENT DOCUMENTS

CA 2060894 A1 * 6/1990 ..... E04G 13/00
CA 2396293 A1 1/2003
(Continued)

OTHER PUBLICATIONS

Product Book 2014, Dee Concrete Accessories II, Division of Tesko Enterprises, Norridge, IL, 2014 (28 pp.).
(Continued)

*Primary Examiner* — Omar F Hijaz
(74) *Attorney, Agent, or Firm* — HOLLAND & HART LLP

(57) ABSTRACT

A cement form made at least in part of a foam material can be used to form a cement foundation of a structure. The cement form can include a cement facing surface oriented vertically and configured to support a volume of cement. The cement can also include a ground facing surface oriented horizontally and configured to contact a ground support surface.

23 Claims, 15 Drawing Sheets

(56) References Cited

U.S. PATENT DOCUMENTS

| | | | | |
|---|---|---|---|---|
| 2,845,684 | A | 8/1958 | Bell | |
| 2,875,500 | A | 3/1959 | Stough | |
| 2,917,803 | A | 12/1959 | Phillips | |
| 3,281,894 | A | 11/1966 | Buff et al. | |
| 3,476,845 | A | 11/1969 | Buff et al. | |
| 3,680,823 | A | 8/1972 | Lougheed | |
| 3,782,680 | A | 1/1974 | Hopkins | |
| 3,797,800 | A | 3/1974 | Loy | |
| 3,888,209 | A | 6/1975 | Boots | |
| 3,938,205 | A | 2/1976 | Spann | |
| 4,101,111 | A | 7/1978 | Bishop | |
| 4,191,722 | A | 3/1980 | Gould | |
| 4,214,326 | A | 7/1980 | Spann | |
| 4,233,700 | A | 11/1980 | Spann | |
| 4,372,299 | A | 2/1983 | Fixel | |
| 4,463,934 | A | 8/1984 | Ochoa et al. | |
| 4,574,017 | A | 3/1986 | Stegmeier | |
| 4,823,534 | A | 4/1989 | Hebinck | |
| 4,837,991 | A | 6/1989 | Shaw | |
| 4,863,307 | A * | 9/1989 | Jones | E01C 11/221 404/8 |
| 4,897,973 | A * | 2/1990 | Foster, Jr. | E04B 1/92 47/33 |
| RE33,550 | E * | 3/1991 | Jones | E01C 11/221 404/8 |
| 5,007,122 | A | 4/1991 | Daughdrill | |
| 5,027,551 | A | 7/1991 | Rodriguez | |
| 5,035,015 | A | 7/1991 | Maietta | |
| 5,073,061 | A | 12/1991 | Jones | |
| 5,092,091 | A | 3/1992 | Hull et al. | |
| 5,096,155 | A | 3/1992 | Fitzgerald | |
| D326,976 | S | 6/1992 | Wickis, Jr. et al. | |
| 5,134,817 | A | 8/1992 | Richardt | |
| 5,212,917 | A | 5/1993 | Kurtz et al. | |
| 5,339,578 | A | 8/1994 | Smerchanski et al. | |
| 5,367,845 | A | 11/1994 | Hartling | |
| 5,452,963 | A | 9/1995 | Christensen | |
| 5,454,195 | A | 10/1995 | Hallsten | |
| 5,524,640 | A | 6/1996 | Lisak et al. | |
| 5,588,262 | A * | 12/1996 | Dawson | B28B 7/0097 47/33 |
| 5,605,416 | A | 2/1997 | Roach | |
| 5,611,641 | A | 3/1997 | Christensen | |
| 5,651,910 | A | 7/1997 | Myers et al. | |
| 5,694,723 | A | 12/1997 | Parker | |
| 5,772,357 | A | 6/1998 | Evans | |
| D399,573 | S | 10/1998 | Stegmeier et al. | |
| 5,836,714 | A | 11/1998 | Christensen | |
| 5,843,327 | A | 12/1998 | Lindgren | |
| 5,956,912 | A | 9/1999 | Carter et al. | |
| 6,021,994 | A | 2/2000 | Shartzer, Jr. | |
| 6,026,623 | A | 2/2000 | Anderson | |
| 6,195,956 | B1 | 3/2001 | Reyneveld | |
| 6,324,782 | B1 | 12/2001 | Gaston | |
| 6,477,817 | B1 | 11/2002 | Yurick | |
| 6,536,737 | B1 | 3/2003 | Davis | |
| 6,705,582 | B2 | 3/2004 | Osborn | |
| 6,735,793 | B2 | 5/2004 | Peterson | |
| 6,742,758 | B2 | 6/2004 | Janesky | |
| 6,951,434 | B2 | 10/2005 | Yodock, Jr. et al. | |
| 7,051,988 | B2 | 5/2006 | Shaw et al. | |
| D552,250 | S | 10/2007 | Christensen et al. | |
| 7,445,403 | B2 | 11/2008 | Williams et al. | |
| 7,506,480 | B1 | 3/2009 | Chandler | |
| 7,874,112 | B2 | 1/2011 | Kovatch et al. | |
| 7,967,524 | B2 | 6/2011 | Jones | |
| 8,011,144 | B2 | 9/2011 | Compton | |
| 8,266,844 | B2 | 9/2012 | Kurtz et al. | |
| D679,173 | S | 4/2013 | Parady et al. | |
| 8,443,517 | B2 | 5/2013 | Curtis | |
| 8,485,603 | B2 | 7/2013 | Albecker | |
| 8,662,790 | B2 | 3/2014 | Phelps | |
| 9,004,815 | B2 | 4/2015 | Taylor | |
| 9,016,980 | B2 | 4/2015 | Wheeler et al. | |
| 9,068,364 | B2 | 6/2015 | Troudt | |
| 9,169,636 | B2 * | 10/2015 | Blank | E04B 1/7023 |
| 9,173,350 | B1 | 11/2015 | Beutler | |
| 9,346,454 | B1 | 5/2016 | Leith | |
| 9,394,650 | B2 | 7/2016 | Diamond | |
| 9,551,163 | B2 | 1/2017 | Anaya Perez | |
| D781,463 | S | 3/2017 | Otto | |
| 10,815,553 | B2 | 10/2020 | Oka et al. | |
| 10,815,663 | B1 | 10/2020 | Dupray | |
| 10,920,391 | B2 | 2/2021 | Boyce et al. | |
| 2002/0062603 | A1 | 5/2002 | Shaw | |
| 2002/0145099 | A1 | 10/2002 | Hoyle et al. | |
| 2002/0157325 | A1 | 10/2002 | Domanico | |
| 2003/0025064 | A1 | 2/2003 | Takagi | |
| 2004/0041074 | A1 | 3/2004 | Takagi | |
| 2004/0156680 | A1 | 8/2004 | Gibbs | |
| 2006/0016956 | A1 | 1/2006 | Bennett et al. | |
| 2006/0131475 | A1 | 6/2006 | Testa | |
| 2006/0284049 | A1 * | 12/2006 | England | B28B 7/28 249/114.1 |
| 2007/0107342 | A1 | 5/2007 | Friedlich | |
| 2007/0193162 | A1 | 8/2007 | Krzowski | |
| 2007/0228254 | A1 | 10/2007 | England | |
| 2007/0259520 | A1 | 11/2007 | Cooper et al. | |
| 2008/0079269 | A1 | 4/2008 | Bushey et al. | |
| 2009/0249704 | A1 | 10/2009 | Wilson et al. | |
| 2010/0024321 | A1 | 2/2010 | Scherer | |
| 2012/0047818 | A1 | 3/2012 | Lopez | |
| 2012/0076588 | A1 | 3/2012 | Dupuis et al. | |
| 2012/0119061 | A1 | 5/2012 | Au | |
| 2012/0126084 | A1 | 5/2012 | Christeson | |
| 2014/0260022 | A1 | 9/2014 | Lewis | |
| 2014/0295725 | A1 | 10/2014 | Passmann et al. | |
| 2015/0159373 | A1 | 6/2015 | Warren | |
| 2015/0184350 | A1 * | 7/2015 | Taylor | E02B 3/106 405/114 |
| 2015/0267374 | A1 | 9/2015 | Lewis | |
| 2015/0354160 | A1 | 12/2015 | Ragsdale, Jr. | |
| 2016/0032585 | A1 | 2/2016 | Park | |
| 2016/0076262 | A1 | 3/2016 | Scott et al. | |
| 2016/0319506 | A1 | 11/2016 | Boyce et al. | |
| 2016/0319507 | A1 | 11/2016 | Boyce et al. | |
| 2017/0291055 | A1 | 10/2017 | Madion | |
| 2018/0320334 | A1 | 11/2018 | Boyce et al. | |
| 2020/0115878 | A1 | 4/2020 | Boyce et al. | |
| 2021/0079669 | A1 | 3/2021 | Boyce et al. | |

FOREIGN PATENT DOCUMENTS

| | | | |
|---|---|---|---|
| CA | 2984737 | A1 | 5/2019 |
| CA | 2845360 | C | 1/2021 |
| CN | 104968871 | A | 10/2015 |
| DE | 1659227 | A1 | 3/1970 |
| DE | 3837377 | C2 | 10/1994 |
| DE | 19520723 | A1 | 12/1996 |
| DE | 19525148 | A1 | 1/1997 |
| DE | 19615637 | A1 | 10/1997 |
| DE | 102008031209 | A1 | 7/2009 |
| DE | 202013000686 | U1 | 6/2014 |
| EP | 1321602 | A1 | 6/2003 |
| FR | 2735525 | A1 | 12/1996 |
| GB | 0656530 | A | 8/1951 |
| GB | 0871439 | A | 6/1961 |
| GB | 2427881 | A | 1/2007 |
| GB | 2434543 | A | 8/2007 |
| GB | 2591266 | A | 7/2021 |
| JP | 2013-231290 | A | 11/2013 |
| KR | 20-0417980 | Y1 | 6/2006 |
| KR | 100844278 | B1 | 7/2008 |
| KR | 20-0442545 | Y1 | 11/2008 |
| KR | 101353546 | B1 | 1/2014 |
| WO | WO-1997/038167 | | 10/1997 |
| WO | 03/56115 | A2 | 7/2003 |
| WO | 2004/106641 | A1 | 12/2004 |
| WO | 2014/168353 | A1 | 10/2014 |

(56) References Cited

FOREIGN PATENT DOCUMENTS

| | | | |
|---|---|---|---|
| WO | 2018/203755 | A1 | 11/2018 |
| WO | 2021/195722 | A1 | 10/2021 |

OTHER PUBLICATIONS

Information about Related Patents, Patent Applications, and Patent Office Proceedings see the section below having the same title.
U.S. Appl. No. 16/713,517, 2020/0115878, filed Dec. 13, 2019, Cement Form Apparatus and Method.
U.S. Appl. No. 15/967,259, U.S. Pat. No. 10,538,893, filed Apr. 30, 2018, Cement Form Apparatus and Method.
U.S. Appl. No. 14/698,674, U.S. Pat. No. 10,024,023, filed Apr. 28, 2015, Cement Form Apparatus and Method.
U.S. Appl. No. 15/136,795, U.S. Pat. No. 10,024,024, filed Apr. 22, 2016, Cement Form With Breakaway Portion.
U.S. Appl. No. 16/034,902, U.S. Pat. No. 10,920,391, filed Jul. 13, 2018, Cement Form With Breakaway Portion.
U.S. Appl. No. 16/571,496, U.S. Pat. No. 11,105,094, filed Sep. 16, 2019, Cement Form With Extension.
U.S. Appl. No. 17/173,196, 2021/0164189, filed Feb. 10, 2021, Cement Form With Breakaway Portion.
U.S. Appl. No. 17/302,584, filed May 6, 2021, Cement Form With Brick Ledge.
U.S. Appl. No. 17/446,315, filed Aug. 30, 2021, Cement Form With Extension.
Filed Herewith, filed Oct. 7, 2021, Cement Form.
Information Submitted in Parent Patent Applications, see MPEP 609.02 and the section below having the same title.

* cited by examiner

CEMENT FORM

TECHNICAL FIELD

The present disclosure generally relates to cement forms used to create cement structures such as building foundations.

BACKGROUND

Traditionally, cement forms are held in place with an arrangement of metal stakes, kickers and other supporting structure. The traditional methods for forming a monolithic building foundation are particularly time intensive to set up and take down after the cement monolithic foundation is poured. After the form is removed, dirt is backfilled around the foundation to provide support and soil grading. In certain cold climates, foam insulation sheets are positioned against the sidewall of the foundation and extending laterally from the sidewall after the form is removed and before dirt is backfilled around the foundation. The foam insulation provides a desired R value that helps hold in heat from the building within the foundation, thereby providing protection again extreme expansion and contraction of the foundation resulting from outside temperature changes.

GENERAL DESCRIPTION

According to one aspect of the present disclosure, a cement form includes a first surface arranged vertically and configured to support a volume of cement, a second surface arranged horizontally and configured to contact a ground support surface, and at least one of a foam material and a polymer material.

The cement form may have a wedge-shaped cross-section. The cement form may have a triangular cross-section shape. The cement form may further include a weight bearing surface facing at least in part in a vertical direction. The cement form may include a connector groove extending along at least a portion of a length of the cement form. The connector groove may be configured to receive a connecting member that extends between adjacent positioned cement forms. The cement form may include at least one aperture sized to receive a support stake extending through the cement form.

Another aspect of the present disclosure related to a cement form that includes an elongate member having a wedge-shaped cross-sectional shape and is formed from a foam material. The elongate member may include a connector groove sized to receive a connecting member that spans between adjacent positioned cement forms. The elongate member may be configured to receive a support stake through the foam material to connect the cement form to a ground surface without pre-forming a pass-through bore in the elongate member sized to receive the support stake. The cement form may be configured to be at least partially covered with backfill dirt prior to forming a cement structure using the cement form. The elongate member may include a first surface arranged vertically and configured to support a volume of cement, and a second surface arranged horizontally and configured to contact a ground support surface. The foam material may include at least one of expanded polyethylene and high-density foam.

A further aspect of the present disclosure relates to a cement form assembly that includes at least two cement forms each comprising at least one of a foam material and a polymer material, and each having at least one connector groove formed therein. The cement form assembly also includes at least one connecting member positioned in the connector grooves and spanning between the at least two cement forms to interconnect the at least two cement forms, and a plurality of support stakes extending through the at least two cement forms and into a ground support.

The at least two cement forms may each have a wedge-shaped cross-section. The cement form assembly may also include an inner insert configured to be spaced inward from the at least two cement forms and arranged to be positioned under a cement structure formed using the cement form. The at least two cement forms each include at least one pass-through bore sized to receive one of the plurality of support stakes.

Another aspect of the present disclosure relates to a method of forming a monolithic foundation. The method includes providing a plurality of cement forms each comprising a foam material, staking the plurality of cement forms to a ground surface, interconnecting at least some of the plurality of cement forms, covering at least a portion of the plurality of cement forms with backfill dirt, thereafter, pouring cement into contact with the plurality of cement forms to form a monolithic foundation, and leaving the plurality of cement forms covered and in contact with the monolithic foundation after the cement cures to provide insulation for the monolithic foundation.

Staking the plurality of cement forms may include driving a stake through the foam material, and driving the stake through the foam material concurrently forms a pass-through aperture through the foam material. Interconnecting the plurality of cement forms may include removably inserting a connecting member into connector grooves of adjacent positioned cement forms. The method may include removing the connecting member from the connector grooves after the cement is cured. The method may include inserting a foam strip into the connector grooves after removing the connecting member.

The above summary is not intended to describe each embodiment or every implementation of embodiments of the present disclosure. The Figures and the detailed description that follow more particularly exemplify one or more preferred embodiments.

DESCRIPTION OF DRAWINGS

The accompanying drawings and figures illustrate a number of exemplary embodiments and are part of the specification. Together with the present description, these drawings demonstrate and explain various principles of this disclosure. A further understanding of the nature and advantages of the present invention may be realized by reference to the following drawings. In the appended figures, similar components or features may have the same reference label.

Figure 1:
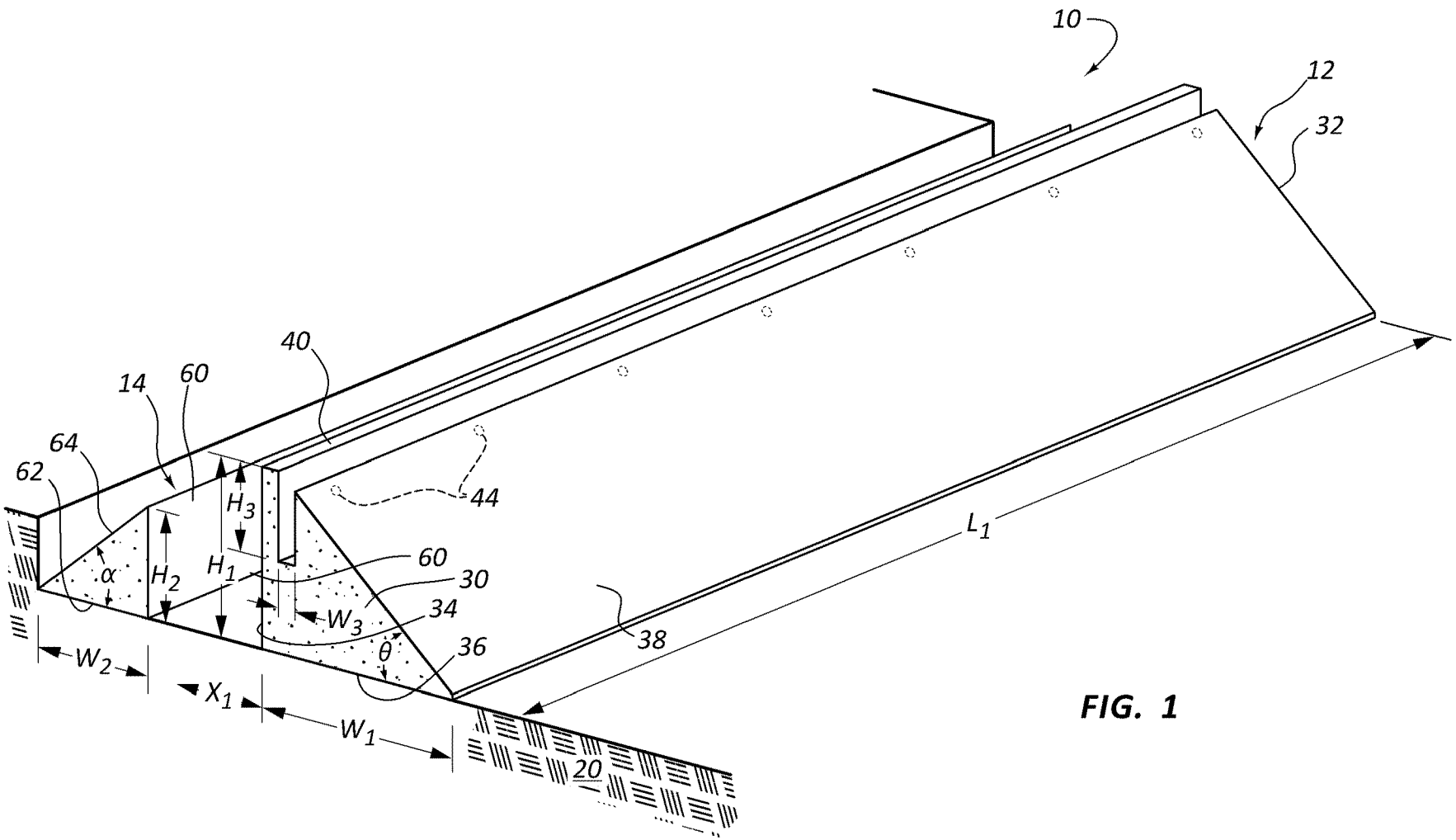
FIG. 1 is a perspective view of a cement form assembly in accordance with the present disclosure.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION OF EMBODIMENTS

The present disclosure generally relates to cement forms used to form cement structures such as cement foundations. The apparatuses and methods of the present disclosure are particularly useful for forming monolithic foundations in which the footings and floor are poured as a single, monolithic structure. The apparatuses and methods of the present disclosure are also particularly useful for forming The disclosed cement forms, cement form assemblies, methods of making cement forms/cement form components, and methods of forming cement structures using the disclosed cement forms may be used in place of traditional wood/metal cement forms that are labor intensive to set up and must be removed after pouring the cement, and foam insulation sheets that are required in cold climates to be buried adjacent to the cement structure (e.g., cement foundation) to limit frost damage to the cement structure.

One aspect of the present disclosure relates to a cement form that is comprised substantially of a foam material such as, for example, expanded polyethylene or high-density foam (e.g., known as Blue Board). The foam cement form may be used to form a cement structure by containing the cement while being poured and cured. The cement form remains in contact with the cement structure to later provide an insulating function to insulate the cured cement. The foam cement form may be at least partially buried prior to pouring the cement. The backfill material used to at least partially bury the foam cement form may help hold the form in place while the cement is being poured and cured.

Another aspect of the present disclosure relates to cement forms formed from a polymer material such as, for example, polyethylene or other polymer. Various molding processes may be used to form the polymer cement form including, for example, blow molding, drape forming, injection molding, and the like. A polymer cement form may include additional intricate features such as support ribs, pass-through bores, grooves, internal cavities, and the like which may be more difficult to form in a foam cement form. Further, a polymer cement form in accordance with the present disclosure may be reusable for forming a plurality of cement structures, wherein the polymer cement form is removed from the cement structure after curing of the cement.

Another aspect of the present disclosure relates to methods of forming a cement structure such as a monolithic foundation. Such methods may include use of a foam cement form or a polymer cement form in accordance with the present disclosure. Such methods may also include the use of an internal insert that is positioned under or internal the cement structure. The internal insert may comprise a foam material, a polymer material, or the like. Typically, the internal insert is provided to help minimize the amount of cement that is needed to create the cement structure. The cost and labor associated with using an internal insert is usually less than the extra amount of cement that may otherwise be required to create the cement structure. In at least some examples, the internal insert may provide an additional insulating property that increases the R value associated with protecting the cement structure from fluctuations in temperature.

A further aspect of the present disclosure relates to methods of forming foam cement forms and polymer cement forms. Such methods may be implemented to provide cost-effective, efficient production of cement forms. The cement forms may be structured as part of such manufacturing methods to facilitate assembly, storage, and shipping that is more efficient and cost-effective than those available for existing cement forms.

Referring to FIGS. 1-5, an example cement form assembly 10 is shown and described. The cement form assembly 10 includes a cement form 12 and an inner insert 14 (see FIG. 1). The cement form 12 and inner insert 14 are particularly useful for forming a building foundation, such as a monolithic foundation. Cement form 12 is used to support an exterior wall of the foundation. The inner insert 14 is positioned spaced inward from the cement form 12 and at a location that defines an inner and bottom surface of the foundation. Each of cement form 12 and inner insert 14 have a wedge-shaped cross-sectional shape in the embodiment shown in FIGS. 1-5. A vertical surface of the wedge shape defines a supporting surface that contains cement that is poured to form the foundation. A bottom, downward facing surface of each of the wedge-shaped structures rests against a ground support and has sufficient width to maintain the cement form 12 and inner insert 14 in an upright position without the use of stakes, kickers, or other structures typically used in known cement form assemblies. The cement form 12 and inner insert 14 may be held in a specific position along the ground support using stakes that are driven through the cement form 12 and inner insert 14 and into the ground support or driven into the ground support at a position directly adjacent to the cement form 12 and inner insert 14. The support stakes are typically not needed to hold the cement form 12 and inner insert 14 in an upright position.

Figure 13A:
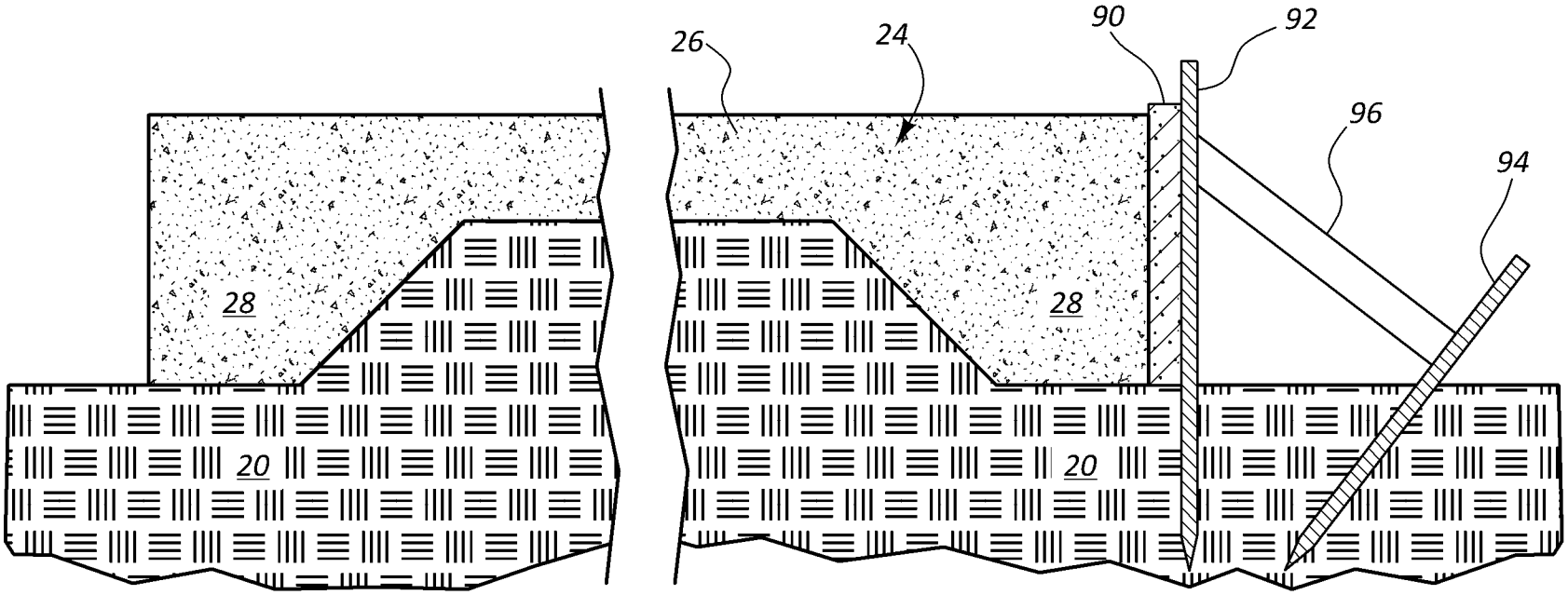
FIG. 13A (Prior Art)
FIGS. 13A and 13B show a prior art cement form assembly.
Figure 13B:
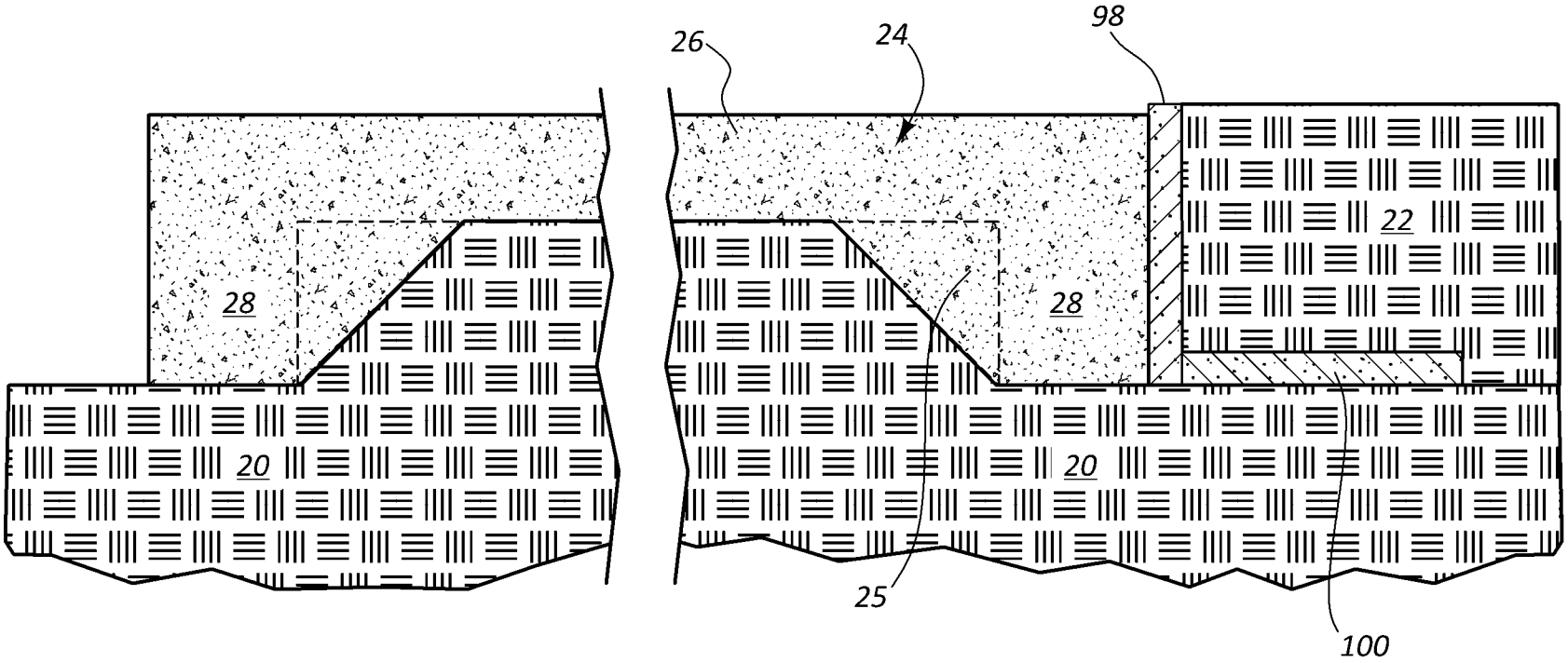
FIG. 13B (Prior Art)

Referring to FIGS. 13A and 13B, a traditional cement form assembly is shown. The traditional assembly includes a cement form 90 that is held in place along a ground support 20 with a plurality of form stakes 92. A plurality of kickers 96 extend diagonally from the cement form 90 to hold the cement form 90 in a vertical, upright position. The kickers 96 are held in place with a plurality of kicker stakes 94. The process of setting up the form assembly shown in FIG. 13A is extremely labor intensive because not only does the cement form 90 need to be held in an upright position, but also needs to be held in a fixed lateral and axial position along the ground support 20.

The ground support 20 is pre-shaped to match the desired dimensions for a slab 26 and footings 28 of a foundation 24. The increased depth required for the footings 28 requires tapering the ground support 20 from the area of the slab 26 to the area of the footings 28. Because the ground support 20 comprises dirt, gravel, or other fill material that is generally loose, it is difficult to form the transition between the slab support area and foundation support area of the ground support 20 in a square shape represented by feature 25 in FIG. 13B. The feature 25 shown in FIG. 13B represents the additional cement that is required to fill the transition space between the slab support portion and foundation support portions of the ground support 20. This additional cement can be significant, particularly when forming large foundations. This additional cement is unnecessary from a structural perspective for the foundation but is a required additional cost when using traditional methods to form monolithic foundations.

Referring to FIG. 13B, after the foundation 24 is poured and cured, the cement form 90, stakes 92, 94 and kicker 96 are removed, and a pair of foam sheets 98, 100 are positioned resting against the exterior, lateral surface of the foundation 24 and against the ground support 20 adjacent to foundation 24. The foam sheets 98, 100 provide insulation for foundation 24 and provide a certain R value. In at least some cases, the foam sheets 98, 100 help retain heat within the foundation 24 so that the heat does not immediately dissipate into backfill 22 that is later used to cover the foam sheets 98, 100 and grade the ground surface adjacent to foundation 24. The backfill 22 may be in the form of dirt, gravel, or other fill material. The backfill 22 holds the foam sheets 98, 100 in their respective positions in contact with the lateral outside surface of foundation 24 and along the ground support 20 extending laterally outward from foundation 24.

The traditional structures and methods of forming monolithic foundations and other cement structures as represented in FIGS. 13A and 13B have many disadvantages, inefficiencies, and unnecessary costs. The apparatuses and methods disclosed herein, particularly with reference to FIGS. 1-12E address many of the drawbacks associated with the traditional apparatuses and methods described with reference to FIGS. 13A and 13B.

Referring again to FIG. 1, the cement form 12 includes first and second ends 30, 32, a first or cement facing surface 34, a second or ground facing surface 36, and a weight bearing or inclined surface 38. Cement form 12 may also include a top surface 40 and a connector groove 42. Cement form 12 may optionally include a plurality of stake openings or apertures 44 positioned along a length $L_1$. The stake openings 44 may be provided as pass-through bores that extend from the weight bearing surface 38 or top surface 40, through the body of cement form 12 and out through second surface 36.

The first surface 34 may be arranged generally vertical or aligned parallel with a vertical plane. First surface 34 may support a volume of concrete that is poured into a space between cement form 12 and inner insert 14. First surface 34 may have any desired shape, size and orientation to provide the desired shape, size and orientation of a resulting surface of a cement structure supported by cement form 12. First surface 34 is shown having a height $H_1$. The height $H_1$ may be in the range of, for example, about 4 inches to about 60 inches, and more preferably in the range of about 12 inches to about 24 inches, which is common for standard monolithic foundations. First surface 34 may include a decorative pattern that results in a decorative pattern formed on the side surface of the cement structure (e.g., foundation). Such a decorative pattern may be visible in the event that cement form 12 is removed and the side surface of the cement structure is exposed for viewing.

Second surface 36 typically is oriented generally horizontally or aligned parallel with a horizontal plane. Second surface 36 rests upon a ground support 20. Typically, the ground support 20 is generally planer or arranged in a horizontal plane at least in the area where the cement form 12 is positioned. Second surface 36 may have a width $W_1$ that is in the range of, for example, about 6 inches to about 48 inches and more particularly in the range of about 12 inches to about 24 inches. In at least some embodiments, the width $W_1$ is substantially equal to the height $H_1$ of first surface 34. The width $W_1$ is typically equal to or greater than the height $H_1$ to provide balance and support for the cement structure being formed. However, the ratio between weight $W_1$ and height $H_1$ may vary based upon a variety of factors including, for example, materials used for cement form 12, the amount of cement supported by cement form 12 and other structural features of cement form 12 such as, for example, the size and shape of connector groove 42, an angle θ that defines an orientation of weight bearing surface 38, the amount of backfill that is possible to cover weight bearing surface 38 prior to pouring the cement structure, and the like.

The weight bearing surface 38 is substantially planer and extends from an outermost edge of second surface 36 toward the first surface 34. A plurality of stake openings 44 may be formed in the weight bearing surface 38. In at least some examples, cement form 12 comprises a material that permits driving a stake through the cement form 12 without preforming a stake opening 44. Driving a stake through the cement form 12 may concurrently form a stake opening. Such materials are commonly foam materials as described above but may include other materials that can be punctured without cracking or otherwise failing structurally. The use of certain foam materials permits driving stakes through cement form 12 at any desired location along the weight bearing surface 38, within connector groove 42, or through top surface 40. In some embodiments, stakes may be driven into ground support 20 at an outer edge of cement form 12 at the interface between second surface 36 and weight bearing surface 38 to prevent sliding of the cement form 12 in at least one direction along ground support 20. Stakes may be temporarily driven into ground support 20 along an opposite edge of cement form 12 at the interface between first and second surfaces 34, 36 prior to pouring the cement structure. Such temporarily position stakes may remain in place while taking other steps related to setting up the cement form assembly 10 such as, for example, inserting connecting members into connector groove 42, driving stakes through stake openings 44 or along the outer edge of cement form 12, and/or at least partially covering weight bearing surface 38 with a backfill dirt or gravel material.

The connector groove 42 may be positioned along the weight bearing surface 38. Connector groove 42 may be accessible along a top side of cement form 12. Connector groove 42 may be open facing in a generally vertical or upward direction. In at least some examples, connector groove 42 is formed in top surface 40 rather than in weight bearing surface 38, or a combination of the two. Connector groove 42 is shown having a maximum height $H_3$ and a width $W_3$. In at least some examples, connector groove 42 is dimensioned to receive a standard board size such as a 2"×4", 2"×6" or 2"×8" board. Such a board may be referred to as a connecting member 16 (see FIGS. 2-3). The boards or connecting member 16 may be positioned within connector groove 42 and spanned between adjacent positioned cement forms 12 to provide an interconnection of adjacent position cement forms 12. Connector groove 42 is sized, shaped and oriented on cement form 12 to provide easy insertion and removal of such connecting members at various stages of setting up cement form assembly 10 and creating a cement structure, such as a monolithic foundation.

Typically, connectors are inserted into connector groove 42 prior to pouring cement to form a cement structure and are later removed after the cement cures so that the connecting members may be reused for other cement form assemblies. The connector groove 42 may have any desired shape and size to accommodate connecting members of different shapes and sizes. In one example, the connecting members are in the form of a sheet of material, a clip structure, a bracket, or the like. Connector groove 42 may be customized in its shape, size and orientation to accommodate such connecting members. In some embodiments, connector groove 42 may extend along the entire length $L_1$. In other examples, the connector groove 42 extends along only a portion of the length $L_1$ such as, for example, along portions directly adjacent to the first and second ends 30, 32.

The material of cement form 12 that is removed in order to form connector groove 42 may be saved and then reinserted in connector groove 42 after removal of the connecting members. This inserted material may help fill connector groove 42 to prevent backfill dirt or other objects from collecting in connector groove 42, which may otherwise reduce the R value of cement form 12 when cement form 12 is left in the ground and used to insulate the cement structure.

The cement form 12 may be used alone or in combination with inner insert 14. Inner insert 14 may eliminate the need for the extra cement 25 shown in FIG. 13B and discussed above. Inner insert 14 may be positioned along the ground support 20 in the area of the footing portion 28 of foundation 24 (see FIG. 13A). Inner insert 14 may be positioned adjacent to that portion of ground support 20 that supports the slab portion 26 of the foundation 24 (see FIG. 13A). Backfill material may be used to cover at least portions of the inner insert 14 on top of or adjacent to the portion of ground support 20 that supports the slab 26 thereby reducing the extra cement 25 that is otherwise needed.

Inner insert 14 includes a cement surface 60, a ground support surface 62, and a backfill support surface 64. Cement surface 60 has a height $H_2$ and is arranged generally vertically and/or in parallel with a vertical plane. Ground support surface 62 has a width $W_2$ and is arranged horizontally and/or parallel with a horizontal plane. Backfill support surface 64 extends from the ground support surface 62 to the cement surface 60 and may be arranged at an angle $\alpha$ is directly dependent on the height $H_2$ and width $W_2$. Inner insert 14 also has a length $L_2$ (see FIG. 1A). Inner insert 14 is typically spaced apart from cement form 12 a distance $X_1$. The distance $X_1$ is typically in a range of about six inches to about 36 inches, and more particularly in the range of about 12 inches to about 24 inches, which is typical for monolithic foundations.

Figure 1A:
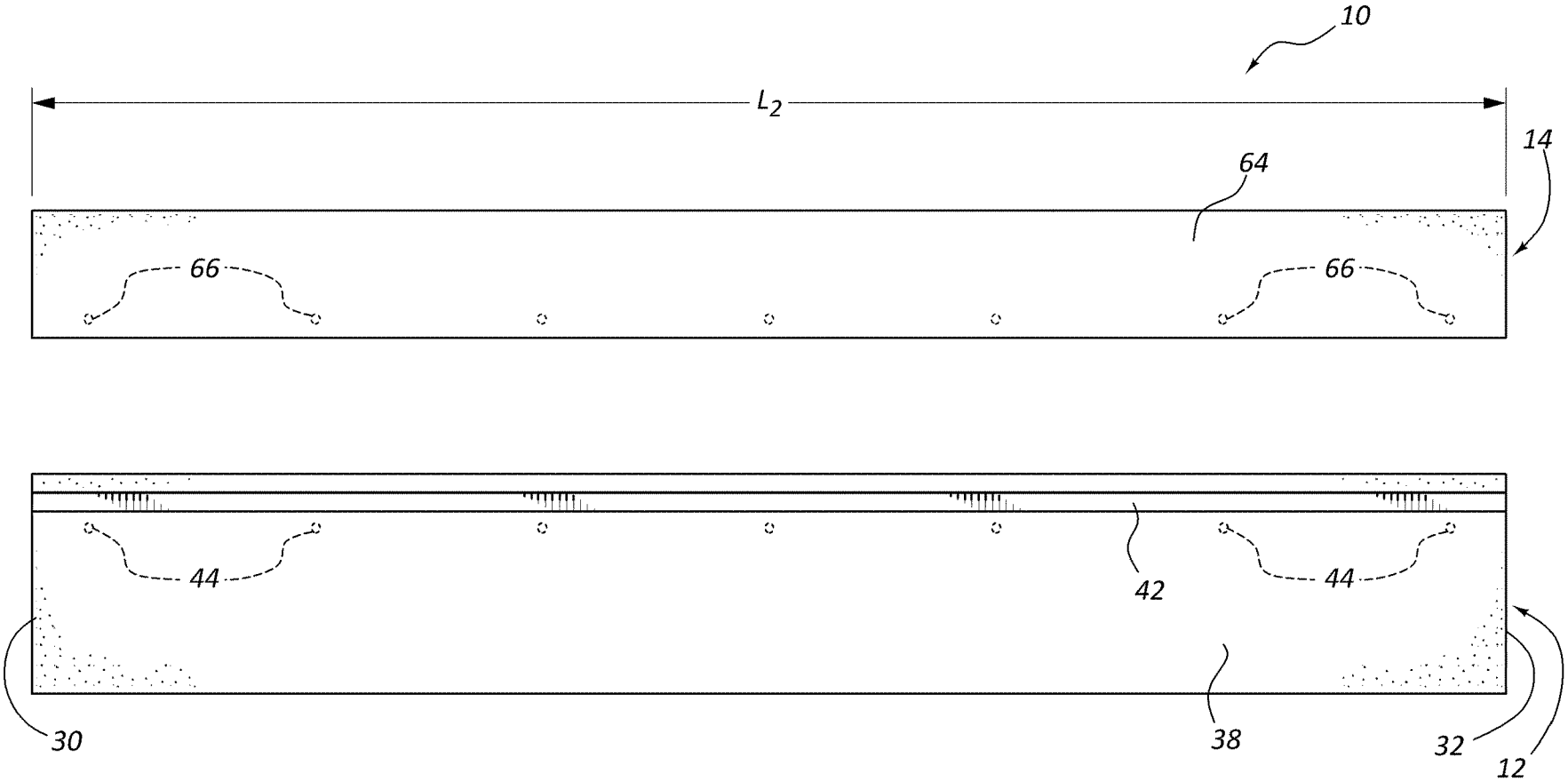
FIG. 1A is a top view of the cement form assembly shown in FIG. 1.

Inner insert 14 may include a plurality of stake openings 66 positioned along the length $L_2$ (see FIG. 1A). Inner insert 14 may comprise a foam material such as polyethylene foam or a high-density foam. In some examples, inner insert 14 comprises a polymer material such as, for example, a polyethylene or other molded material. The materials used for inner insert 14 may be the same as those used to form cement form 12. Certain materials used for inner insert 14 may permit forming of the stake opening 66 as stakes are driven through inner insert 14 and into ground support 20. In other examples, the stake opening 66 are pre-formed as, for example, pass-through bores that extend from backfill support surface 64 through ground support surface 62. The stake opening 66 may be formed at any location along the backfill support surface 64. In at least some examples, stakes are driven into ground support 20 adjacent to inner insert 14 but not extending through any portion of inner insert 14 to hold inner insert 14 in position during various steps leading up to pouring the cement structure. For example, stakes may be positioned along the cement surface 60 to hold inner insert 14 in position while backfill material is placed on the backfill support surface 64, and those stakes are removed prior to pouring the cement structure.

Figure 2:
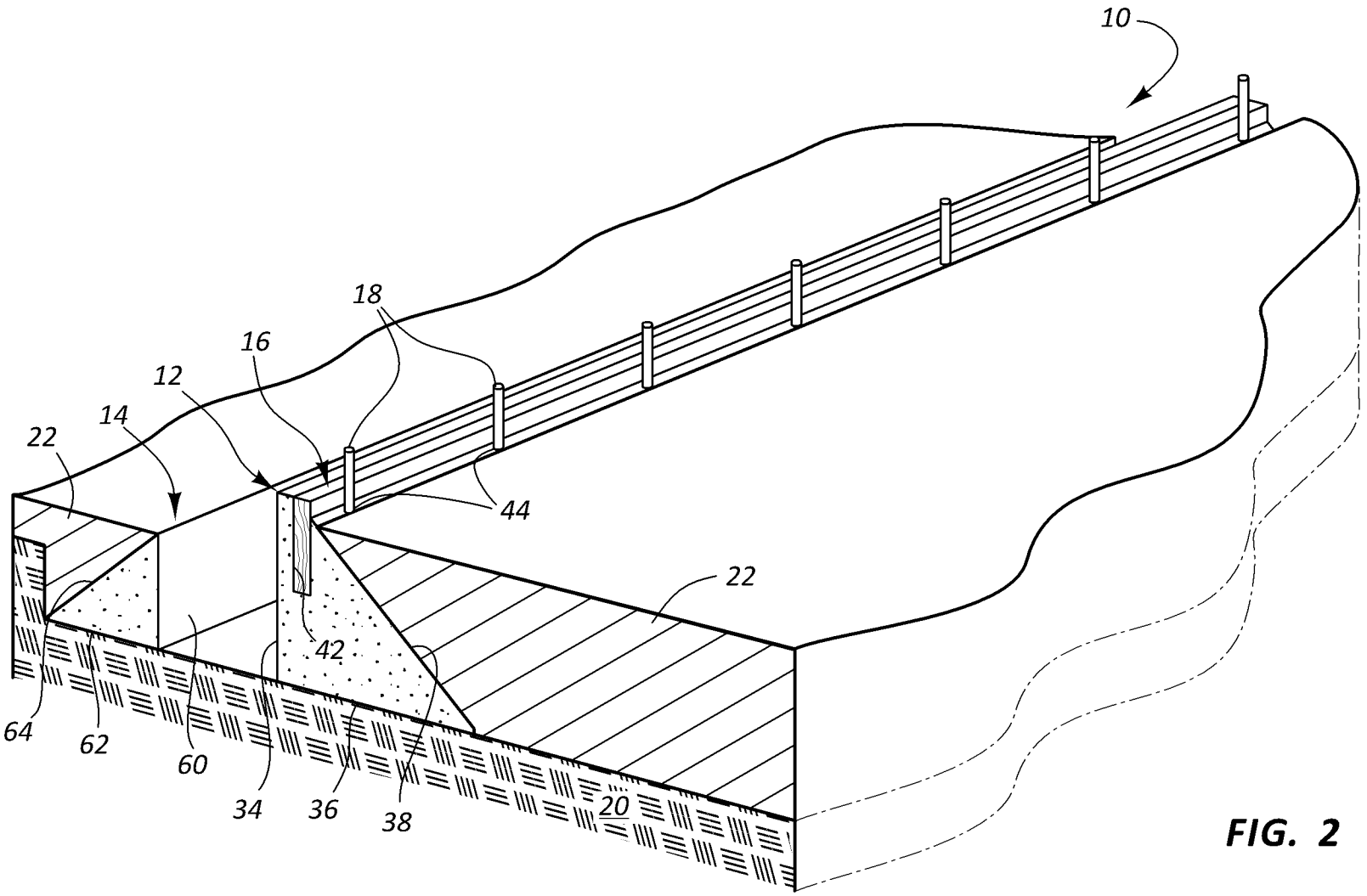
FIG. 2 is a perspective view of the cement form assembly shown in FIG. 1 with connecting members.

Referring to FIG. 2, the cement form assembly 10 is shown with connecting member 16 positioned in connector groove 42, stakes 18 driven through cement form 12 and into ground support 20, and backfill 22 positioned covering at least portions of the weight bearing surface 38 of cement form 12 and substantially all of the backfill support surface 64 of inner insert 14. The cement form assembly 10 is shown prepared for pouring cement to create a cement structure (e.g., monolithic foundation). Typically, the backfill dirt 22 is filled up to the connector groove 42 but typically not covering the connecting members 16. The backfill 22 can be filled to any desired height but is typically always vertically lower than the connector groove 42 and/or the top surface 40. The stakes 18 may have ends that protrude through backfill 22 or may be positioned on cement form 12 in a way that they are completely buried by backfill 22. The stakes 18 may extend above the cement form 12, particularly above the weight bearing surface 38 or top surface 40 into which the stakes are driven. The stakes 18 may be later removed. In at least some examples, the stakes 18 are left positioned in cement form 12 even after the cement structures is cured. The stakes 18 may be in the form of, for example, wood or other insulating material that does not significantly reduce the R value of the cement form 12. Further, stakes 18 may comprise a relatively low-cost material that makes it possible from a cost perspective to leave the stakes 18 positioned in cement form 12 permanently. In some examples, stakes 18 may be driven into ground support 20 a distance that buries then within the cement form 12 or at least flush with the weight bearing surface 38 and/or top surface 40 so that they are no longer exposed outside of backfill 22.

The backfill dirt 22 is typically graded to the top edge of inner insert 14 as shown in FIG. 2. In at least some examples, the top edge of inner insert 14 includes a flat surface, round surface, or the like to help reduce or otherwise minimize stress concentrations at an internal corner feature formed in the cement structure. Some additional inner insert embodiments are shown and described below with reference to FIGS. 12A-12E.

Figure 3:
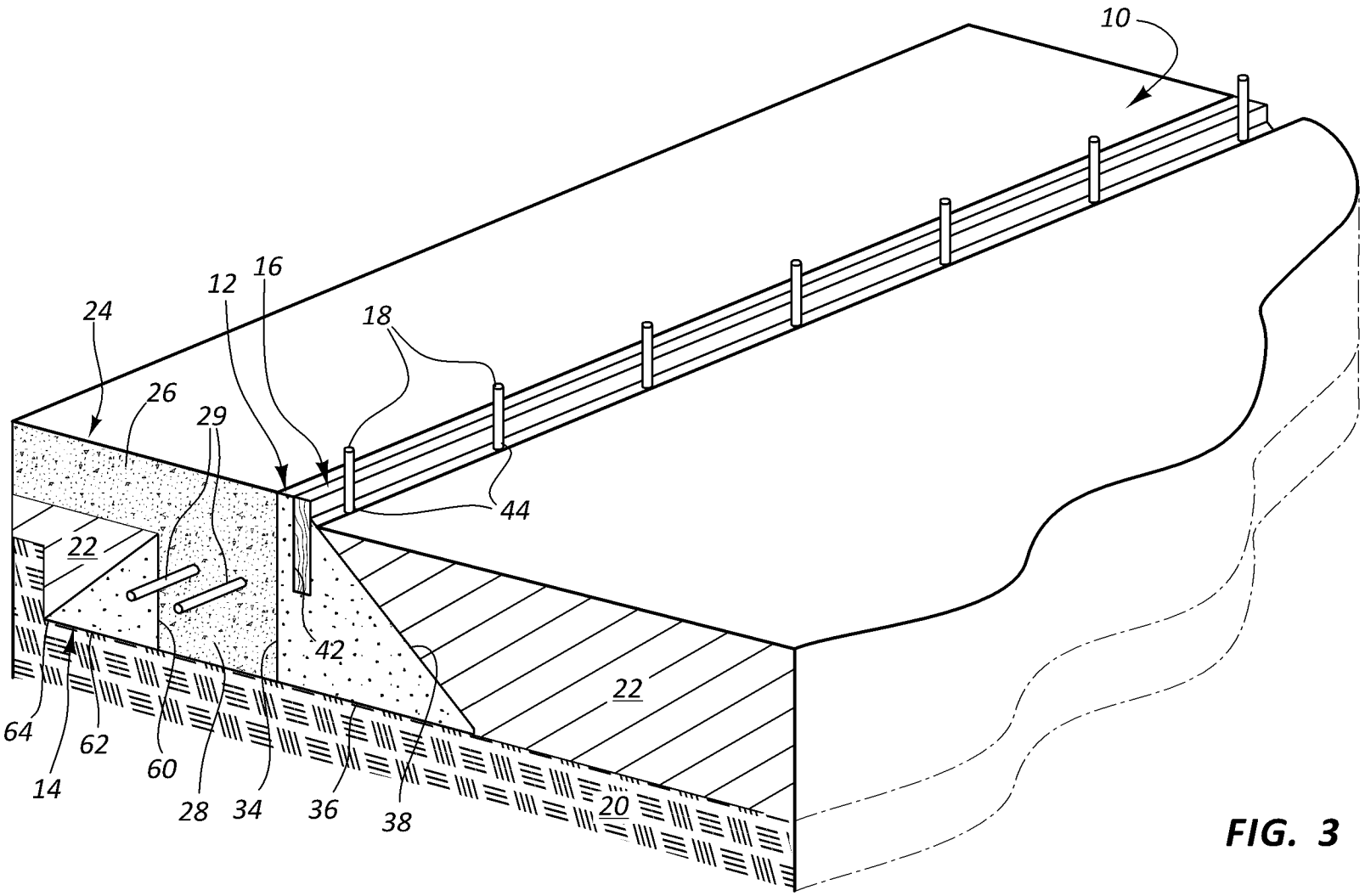
FIG. 3 is a perspective view of the cement form assembly of FIG. 2 used to form a monolithic foundation.

Referring to FIG. 3, a cement structure in the form of a monolithic foundation 24 is shown poured into the space between cement form 12 and inner insert 14 and covering inner insert 14. Foundation 24 includes a slab portion 26 and a footing portion 28. Foundation 24 may also include a plurality of rebar members 29 positioned internally. The cement form 12 is held in place laterally by stakes 18 and backfill 22. Cement forms 12 are also held in alignment relative to each other (e.g., relative to an adjacent cement form 12 that is positioned end to end therewith) with connecting members 16. Inner insert 14 may be held in place laterally and vertically using a plurality of stakes (not shown) and backfill 22. In at least some examples, the inner inserts 14 may also be interconnected with adjacent position inner inserts using connecting members such as connecting members 16. The connecting members may be positioned within connector grooves or other features formed in inner inserts 14 to promote interconnection of the adjacent position inner inserts 14.

In at least some examples, the cement structure (e.g., foundation 24) may be poured without first covering at least a portion of cement form 12 with backfill 22. For example, the connecting member 16 and stakes 18 may provide sufficient support and connection between cement form 12 and ground support 20 that no backfill 22 is needed. However, in at least some examples, backfill 22 is used to cover at least portions of cement form 12 to provide additional support for cement form 12 during pouring of the cement. Applying backfill 22 may also make it easier for a cement truck to move close to cement form 12 for purposes of delivering the cement as part of the cement pouring process. An additional benefit of pre-filling the backfill 22 before pouring the cement is that most, if not all of the grading associated with the cement structure (e.g., foundation 24) may be completed prior to pouring the cement without requiring a further follow-up grading step.

Figure 4:
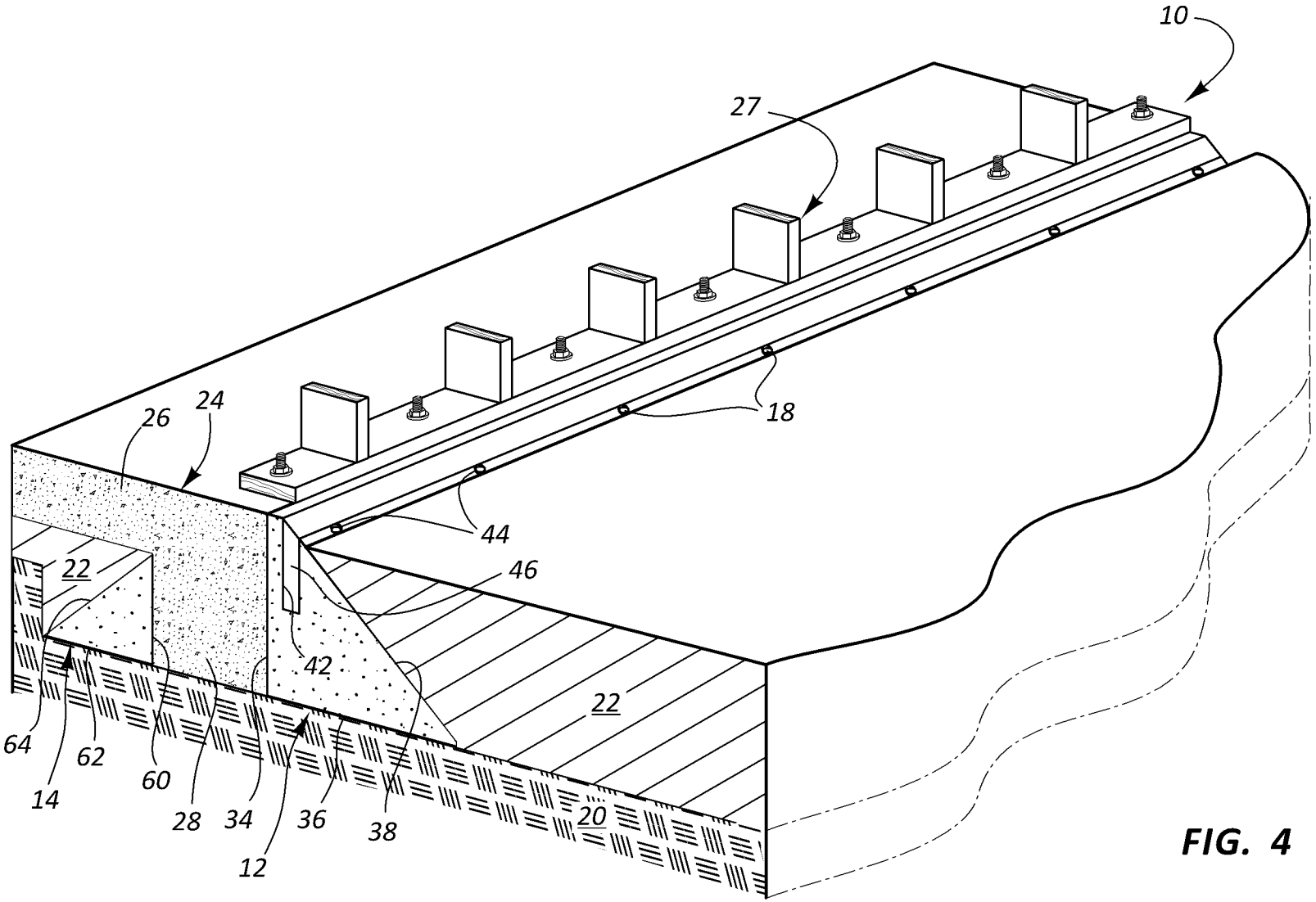
FIG. 4 is a perspective view of the cement form assembly shown in FIG. 3 with connecting members removed and a structure supported on the foundation.

Referring now to FIG. 4, the foundation 24 is shown with a building structure (e.g., wall 27) including a plurality of boards positioned along a top surface of the foundation 24. The connecting members 16 may be removed from connector groove 42 and reused in another cement form assembly. The stakes may be removed from stake openings 44 or may be driven further into stake openings 44 to be flush with weight bearing surface 38 or at least the top surface of backfill 22. In at least some examples, the connector groove 42 may be filled with a strip 46 (also referred to as insert 46). The strip 46 may comprise the same material as the rest of the cement form 12. In at least some examples, the strip may be the material that was removed from cement form 12 as part of forming connector groove 42. Strip 46 may fill connector groove 42 to limit the amount of material or other objects that may otherwise fill connector groove 42. Using the strip 46 within connector groove 42 may improve the aesthetics of the exposed portion of cement form 12. In other embodiments, connector groove 42 may be filled with other materials such as, for example, an expandable foam or other insulating material that is different than the material of cement form 12.

Figure 5:
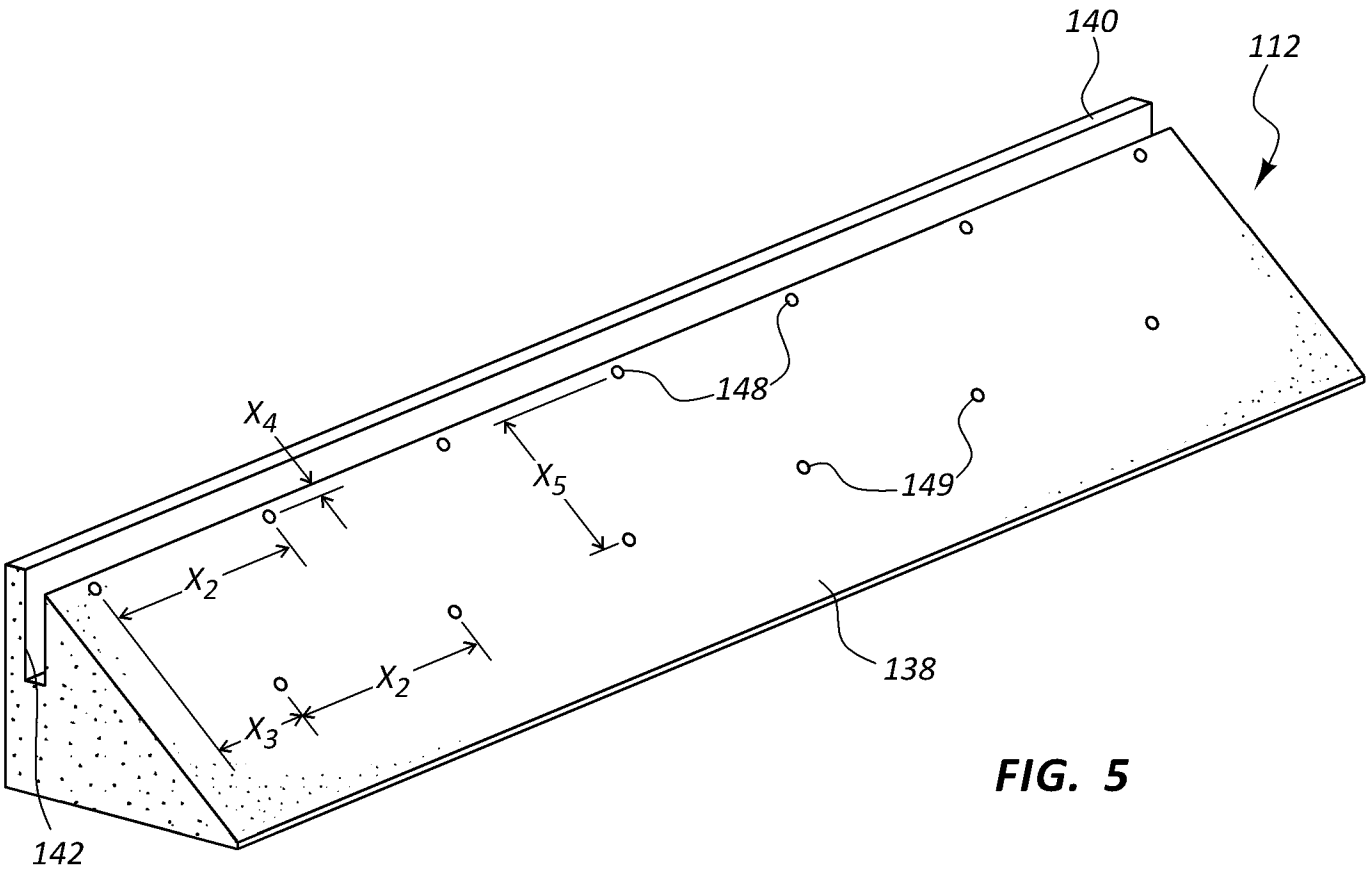
FIG. 5 is a perspective view of another cement form in accordance with the present disclosure.

FIG. 5 shows another example cement form 112 that includes a plurality of stake openings 148, 149. The stake openings 148, 149 are shown arranged in two rows along the length of the cement form 112. The stake openings 148, 149 are spaced apart a distance $X_2$ within each given row. The stake openings 148 may be offset from the stake openings 149 in the other row by a distance $X_3$. The stake openings 148 may be spaced from connector groove 142 a distance $X_4$. The rows of stake openings 148, 149 may be spaced apart a distance $X_5$. Each of the distances $X_2$, $X_3$, $X_4$, $X_5$ may be individually modified to provide a pattern or arrangement of stake openings 148, 149 on the cement form 112. Stake openings 148, 149 may also be positioned along a top surface 140 of the cement form 112. In other examples, additional or fewer rows and numbers of stake openings 148, 149 may be used.

The cement form 112 may be formed from any desired material. In at least some examples, the stake openings 148, 149 are formed concurrently with forming the cement form 112 via, for example, a molding/forming process. In other examples, the stake openings 148, 149 are formed in a separate step after the cement form 112 has been formed (e.g., using a drilling, cutting, stamping or other method for removing material to create the stake openings 148, 149).

Figure 6:
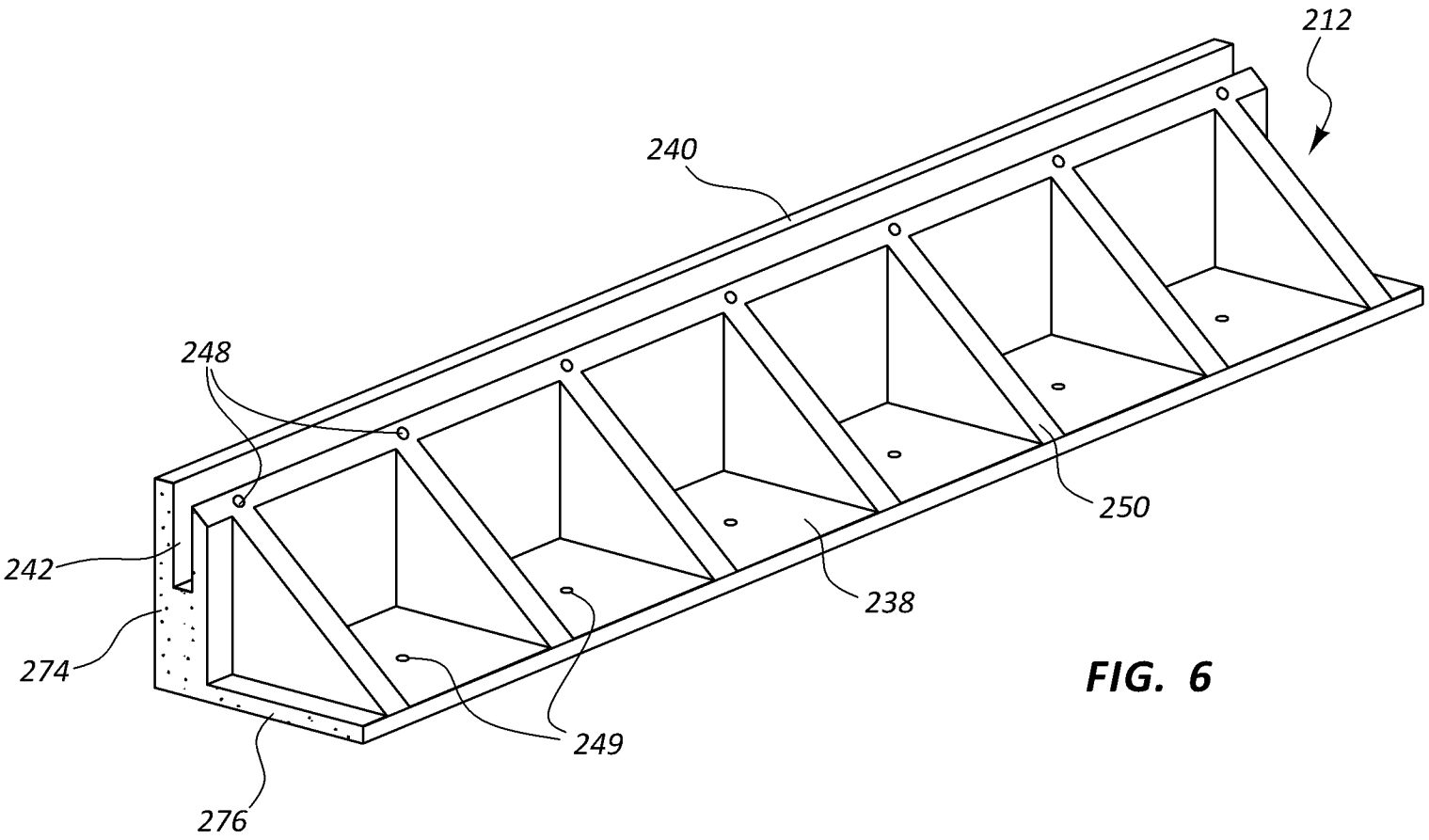
FIG. 6 is a perspective view of another cement form in accordance with the present disclosure.

FIG. 6 shows the cement form 212 embodiment that includes a plurality of support ribs 250. The support ribs 250 may extend between a vertical portion 274 and a bottom or horizontal portion 276. A plurality of upper stake openings 248 may be included along an upper portion of the rib 250 or along a top surface 240 or other portion of the vertical portion 274. A plurality of lower stake openings 249 may be positioned along a weight bearing surface 238 and/or other portion of the horizontal portion 276. Other stake openings 244 may be positioned along other portions of ribs 250 or at other locations on cement form 212. The cement form 212 may include any desired number, arrangement, size, orientation and the like associated with the stake openings 248, 249. Furthermore, a cement form 212 may include any desired number, shape, size and orientation for the ribs 250. In at least some embodiments, cement form 212 may be void of the connector groove 242 and the ribs 250 may extend to top surface 240.

Figure 7:
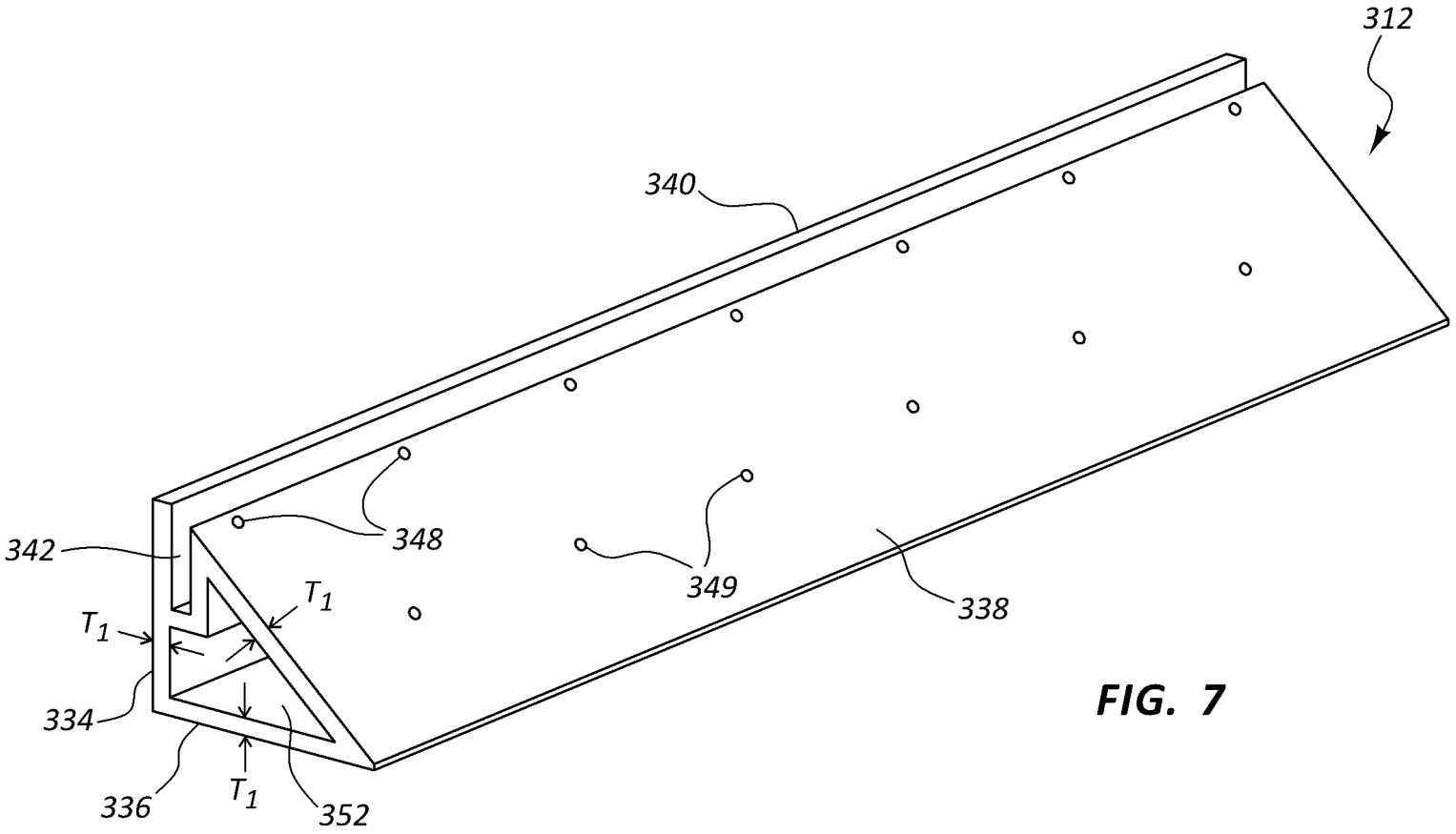
FIG. 7 is a perspective view of another cement form in accordance with the present disclosure.

FIG. 7 illustrates another example cement form 312 having a hollow interior 352. The hollow interior 352 may be formed during formation of the cement form 312 such as, for example, during a molding process. Alternatively, hollow interior 352 may be formed after the cement form 312 has been formed using, for example, a coring, cutting, stamping, drilling, or other material removing process. Cement form 312 may include a plurality of upper and lower stake openings 348, 349. The stake openings 348, 349 may extend through the weight bearing surface 338 and the second surface 336.

Cement form 312 may also include a connector groove 342 and a first face 334. The hollow interior 352 may provide for a relatively constant wall thickness $T_1$ that define each of the first and second surfaces 334, 336 and the weight bearing surface 338.

Cement form 312 is shown as an integrally formed, single piece. In other embodiments, cement form 312, along with other cement form embodiments disclosed herein, may comprise a plurality of parts that are separately formed and then later assembled together. In other embodiments, the cement form 312 may be formed as a wedge-shaped structure having a solid construction. In a later manufacturing step, portions of the wedge-shaped structure may be removed to form at least some of the features shown in FIG. 7. For example, the top surface 340 may be formed by cutting off a pointed edge of the wedge-shaped structure, the connector groove 342 may be formed by cutting out a portion of the solid structure, and the hollow interior 352 may be formed by removing an interior portion of the wedge-shaped structure. Many types of manufacturing processes and/or steps may be possible to form any one of the cement forms and associated cement form features disclosed herein.

Figure 8:
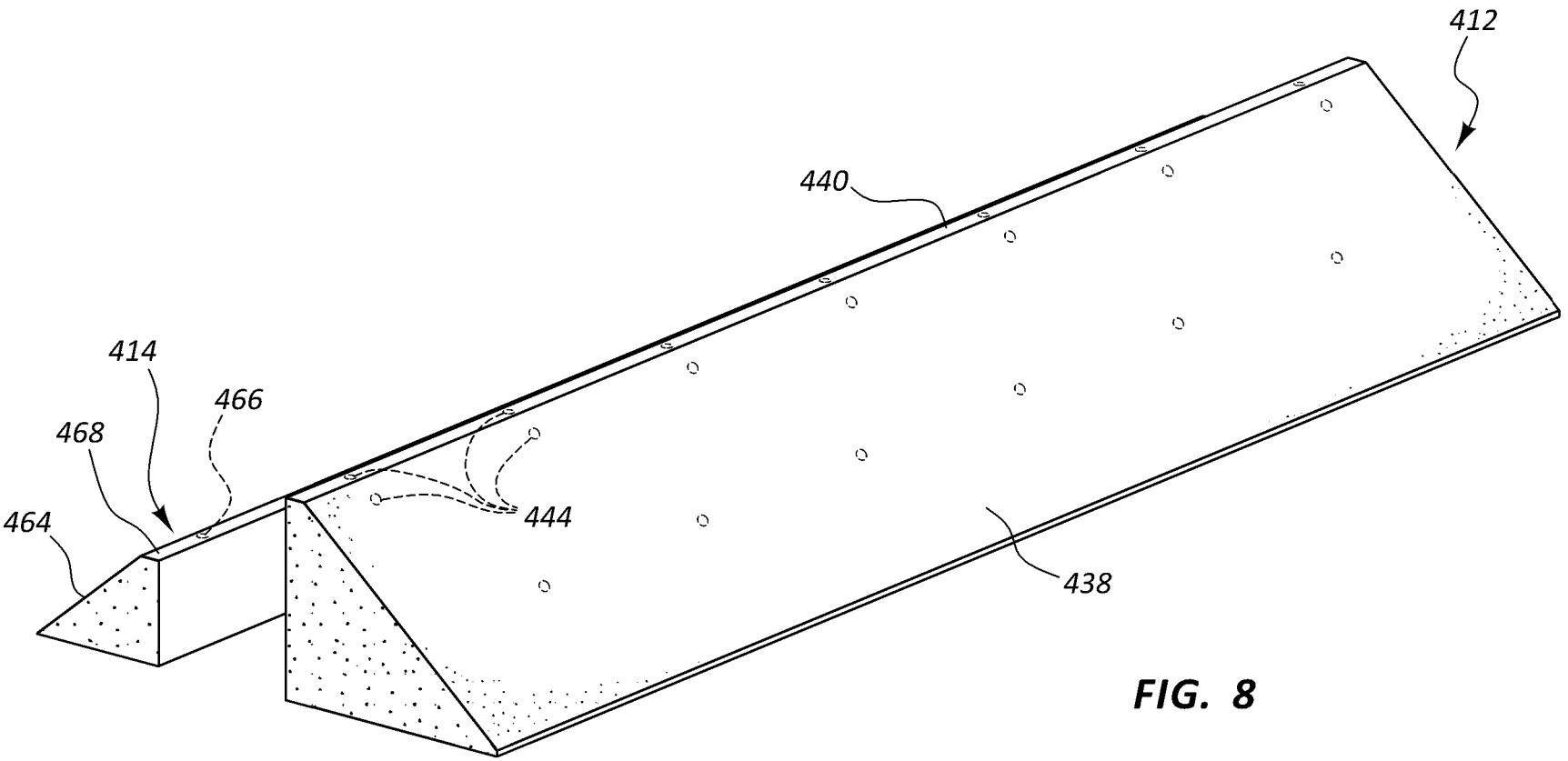
FIG. 8 is a perspective view of a cement form and inner insert in accordance with the present disclosure.

Referring to FIG. 8, another example cement form 412 and inner insert 414 are shown and described. The cement form 412 does not include a connector groove as shown in the embodiments of FIGS. 1-7. The cement forms 412 may be interconnected with adjacent cement forms using other structures and/or devices as opposed to the connecting members 16 described above with reference to FIGS. 1-4. For example, adjacent cement forms 412 may be connected to each other with clips or brackets that attach to the weight bearing surfaces 438.

The cement form 412 and inner insert 414 may include a plurality of stake openings 444, 466, respectively. The cement form 412 may include a top surface 440, and the inner insert 414 may include a top surface 468. The stake openings may be formed in the top surfaces 440, 468. Alternatively, the stake openings 444, 466 may be formed on other surfaces such as, for example, the weight bearing surface 438 and backfill support surface 464, respectively. The stake openings may be pre-formed or formed concurrently as stakes are driven through the cement form 412 and inner inserts 414 and into a ground support. The cement form 412 and inner insert 414 may comprise materials that permit such forming of the stake openings as the stakes are driven through the structure of the cement form 412 and inner insert 414.

The top surface 440 may provide a planer surface that provides an improved transition between cement form 412 and a top surface of a cement structure that is formed using the cement form 412. In at least some examples, the cement structure is created to be flush with the top surface 440. The inner insert 414 may include a top surface 468 to provide improved support of the resulting cement structure at the inner insert 414 as used to form and later support an underside surface of the cement structure. The top surface 468 may also provide improved ease of grading the backfill to the top edge of inner insert 414. Providing the top surface 468 as at least a partial planer surface may reduce the chance of damaging the top edge of the inner insert 414 during the grading process.

Figure 9B:
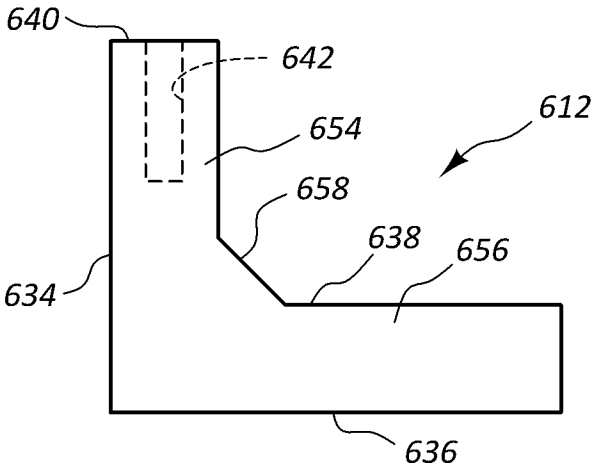
FIGS. 9A-9D are end views of further cement form embodiments in accordance with present disclosure.
Figure 9D:
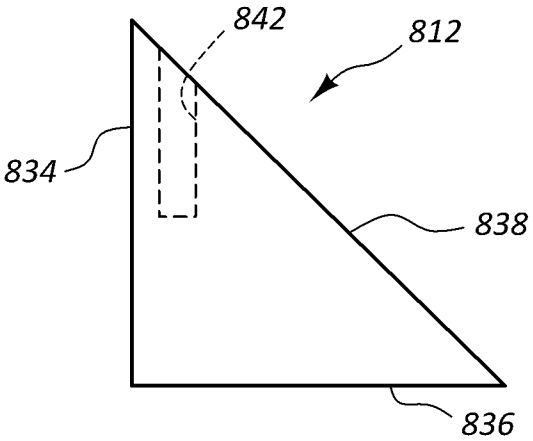
Figure 9A:
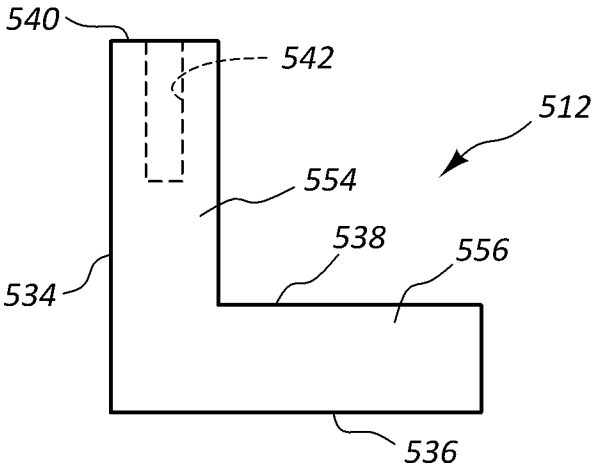

FIGS. 9A-9D show alternative cross-sectional shapes for the cement forms disclosed herein. For example, FIG. 9A shows an L-shape having a vertical leg 554 and a horizontal leg 556. The vertical leg 554 defines a first surface 534 that supports the cement structure during pouring of the cement, and a top surface 540. A connector groove 542 may be formed in the top surface 540. The horizontal leg 556 may define the second surface 536 as well as a weight bearing surface 538. The vertical and horizontal legs 554, 556 may have a substantially similar thickness, which may provide a constant R rating. The thicknesses of the vertical and horizontal legs 554, 556 may provide sufficient structural rigidity to support the poured concrete. The cement form 512 may include a plurality of stake openings that are formed in, for example, the top surface 540 or the weight bearing surface 538.

FIG. 9B shows a cement form 612 having a vertical leg 654 and a horizontal leg 656. A brace portion 658 may extend between the legs 654, 656 to provide additional support there between. The use of brace portion 658 may make it possible to have a reduced thickness for the vertical and horizontal legs 654, 656 because the brace portion 658 provides additional support and structural rigidity. The vertical leg 654 may define the first surface 634 and a top surface 640. A connector groove 642 may be formed along the top surface 640 or along any other desired portion of the cement form 612. The horizontal leg 656 may define the second surface 636 and the weight bearing surface 638. A plurality of stake openings may be formed in, for example, the weight bearing surface 638 and/or the top surface 640.

The brace portion 658 may extend in equal parts to the vertical leg 654 and the horizontal leg 656. In other examples, the brace portion 658 may have a non-uniform, non-symmetrical construction. The brace portion 658 may extend along an entire length of the cement form 612. In other embodiments, the brace portion 658 may be provided as rib features that extend along only portions of the length of the cement form 612.

Figure 9C:
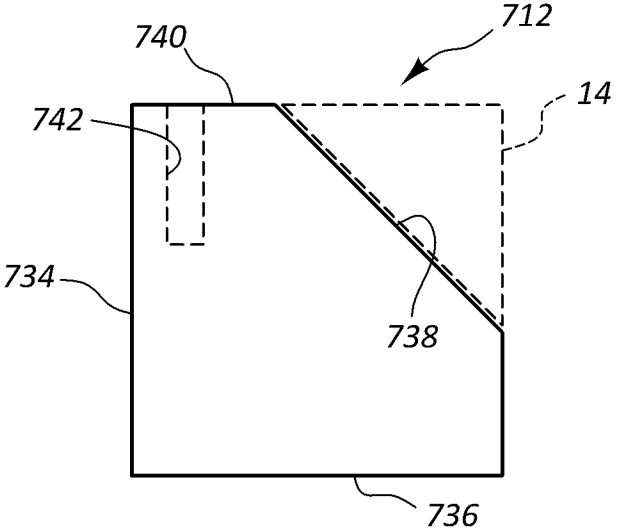

FIG. 9C illustrates a cement form embodiment 712 having a semi-wedge-shaped construction and a semi-block shaped construction. In one example, the cement form 712 is formed from a block of material (e.g., foam material) that has a generally square shaped cross-section. A portion of the square shaped cross-section is removed. The removed portion may be the desired size for the inner insert 14.

The cement form 712 has a greater thickness throughout that provides an improved R rating as compared to other embodiments such as the embodiments of FIGS. 9A, 9B and 9D. The construction of cement form 712 may provide for an improved structural rigidity, stability while pouring the cement, and the like. The increased thickness may make it possible to use less dense and/or less rigid materials for the cement form 712 while still achieving the desired function of serving as a cement form and an insulating material.

Cement form 712 may include first and second surfaces 734, 736 and a weight bearing surface 738. A top surface 740 may extend along a top edge thereof. A connector groove 742 may be formed, for example, the top surface 740 and/or the weight bearing surface 738. Cement form 712 may include a plurality of stake openings pre-formed therein. In at least some examples, cement form 712 may comprise of materials that permit concurrent forming of a stake opening as the stake is driven through the material of the cement form 712.

FIG. 9D illustrates another example cement form 812 that has a right angle, triangular shape with two legs having equal lengths. The generally symmetrical shape of cement form 812 may make it possible to form two cement forms 812 from a single block of material having a square cross-sectional shape, while maintaining equal lengths for each of the first and second surfaces 834, 836. A connector groove 842 may be formed in a weight bearing surface 838. The cement form 812 may be void of a generally planer top surface as is included in other embodiments disclosed herein. Cement form 812 may include a plurality of pre-formed stake openings formed therein or may comprise materials that permit concurrent formation of stake openings as stakes are driven through the material of cement form 812.

Many other triangular shapes are possible for the cement form 812 by modifying the relative lengths between surfaces 834 and 836. Maintaining a right-angle relationship between surfaces 834, 836 may be a constant feature among all of the various triangular shapes that are possible. The triangular shape of the cement form 812 may provide improved stacking of cement forms for purposes of storage, shipping, etc. Providing cement forms 812 having mirrored shapes maximizes storage space and may provide compact, efficient storage and/or shipping. Other designs disclosed herein provide similar benefits including, for example, the cement form 712 and inner insert 14 shown in FIG. 9C.

Figure 10B:
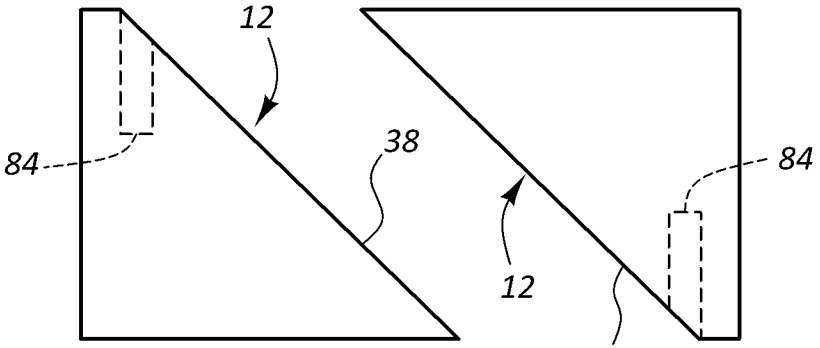
FIGS. 10A-10C show steps of forming a cement form in accordance with the present disclosure.
Figure 10C:
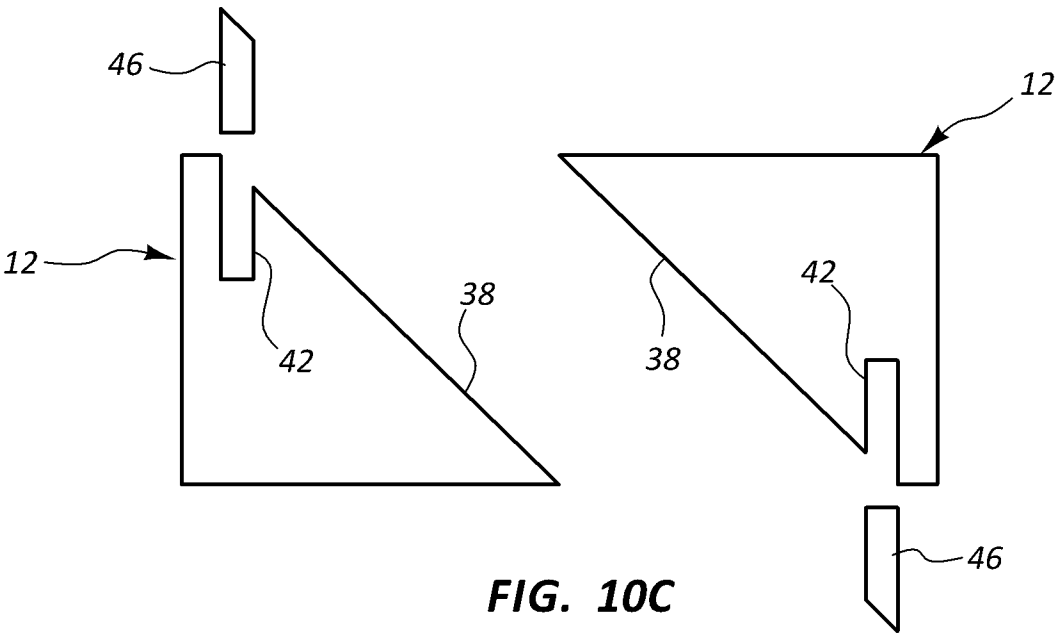
Figure 10A:
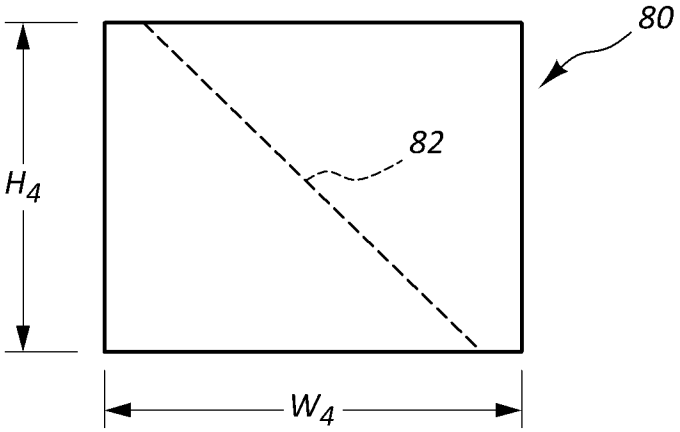

FIGS. 10A-10C show steps of manufacturing a pair of cement forms 12 in accordance with the present disclosure. FIG. 10A shows a block of material 80 having a rectangular cross-sectional shape. The rectangular shape having a slightly greater width $W_4$ than height $H_4$ makes it possible to maintain equal dimensions for the resulting first and second surfaces 34, 36 of each cement form 12 while also providing a flat top surface 40 for each of the cement forms 12. Other embodiments may include use of a block of material 80 having a square shaped cross-section and provide the same or similar benefits.

FIG. 10A shows a cut line 82 that is used to cut the block in half to create two separate cement forms 12 as shown in FIG. 10B. After the cement forms 12 are separated, connector grooves 42 may be formed with cuts 84. FIG. 10C shows removable strips 46 taken from connector groove 42 as a result of cuts 84. The strip 46 may be removed to make room for a connecting member such as connecting member 16 described with reference to FIGS. 1-4. The strip 46 may be replaced in connector groove 42 after removing connecting member 16 (e.g., after the cement structure has been formed) so that the connecting members can be used with a different cement form assembly. The connecting members can be reused for different cement pouring projects and the strips 46 may be used to fill connector groove 42 to prevent unwanted objects from entering connector groove 42 and to help maintain a desired R value for cement form 12.

The forming method described with reference to FIGS. 10A-10C is particularly useful when the material of block 80 comprise a foam material such as those foam materials described herein. However, other materials may be used such as, for example, polymer materials or other insulating materials. Using just three cuts (cuts 82 and two cuts of 84), two separate cement forms may be formed from a single block of material and at relatively low manufacturing and material cost. In embodiments in which the cement forms 12 do not require a connector groove, a single cut 82 through block 80 may result in two completed cement forms 12 that are ready for use.

Figure 11:
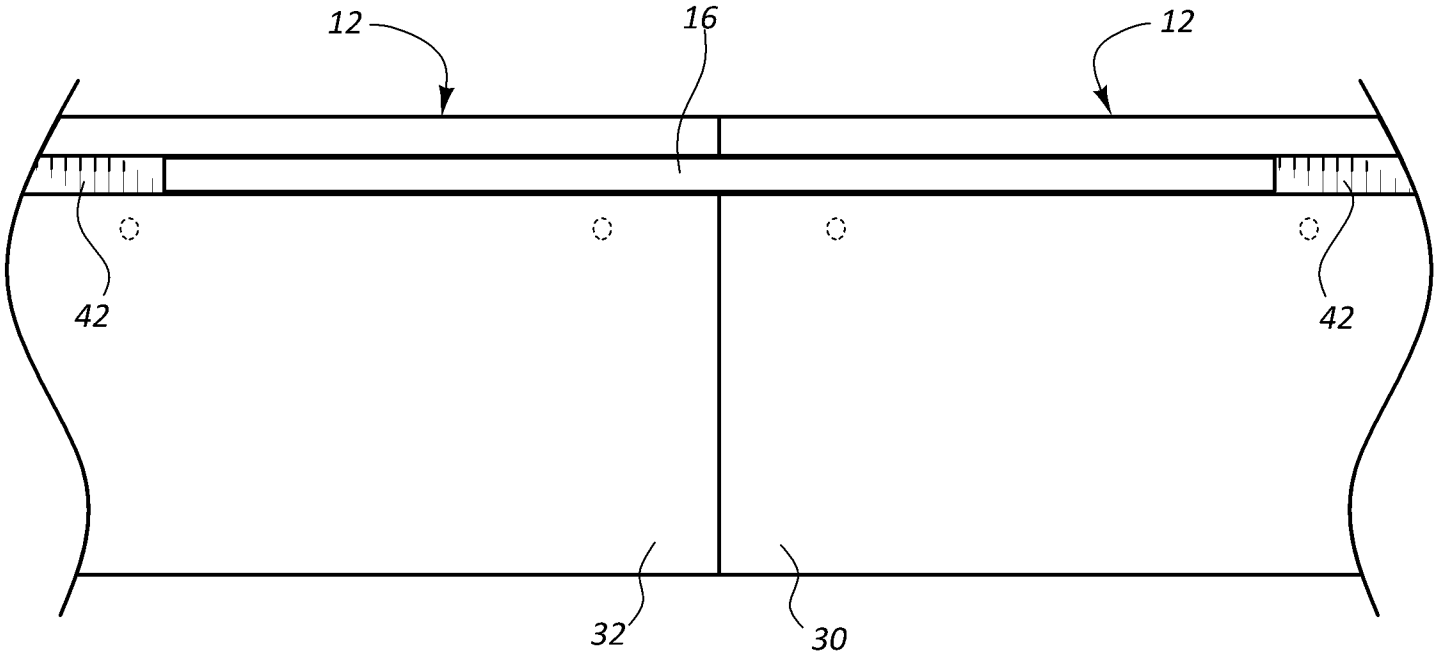
FIG. 11 is a top view of a pair of cement forms interconnected in accordance with the present disclosure.

FIG. 11 shows two cement forms 12 positioned end-to-end in a top view. A connecting member 16 is positioned within connector grooves 42 of the adjacent cement forms 12. The connecting member 16 spans the two cement forms 12. Typically, the cement forms 12 are positioned end-to-end in alignment with each other such that the connector grooves 42 are in alignment with each other. The connecting member 16 is then positioned within the connector groove 42.

A single connecting member 16 may span multiple cement forms 12 such as three or more cement forms. In some arrangements, the connecting member 16 has a length that is substantially the same as the length $L_1$ of cement form 12. Positioning a plurality of connecting members 16 end-to-end within the connector grooves of a plurality of aligned cement forms 12 may completely fill the connector grooves of all of the cement forms. In other examples, a relatively short cement form may be used within the connector groove 42 at or adjacent at the mating first and second ends 30, 32 of adjacent positioned cement forms 12 as shown in FIG. 11. The connector groove 42 may have a length that is customized for a particular length connecting member 16.

In other embodiments, the adjacent position cement forms 12 may be interconnected with different structured connecting members providing different functions. For example, the connecting members may include claws or barb features that grasp the material of the cement forms 12 without the need for a pre-forming groove or other apertures sized to receive the claw/barb features.

Figure 12A:
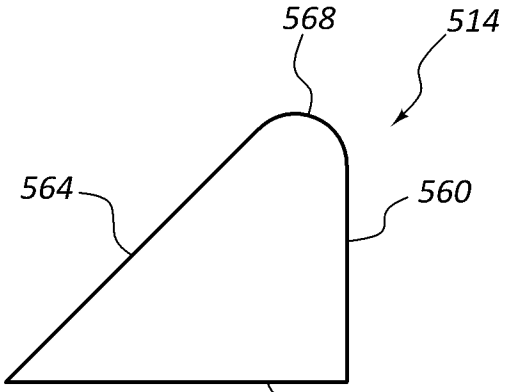
FIGS. 12A-12E are end views of inner insert embodiments in accordance with the present disclosure.

FIGS. 12A-12E illustrate alternative embodiments for inner inserts used with the cement form assemblies described herein. FIG. 12A shows an inner insert 514 having a wedge-shaped construction with a contoured top surface 568. The contoured upper edge (also referred to as a top surface 568) may provide a reduced stress point in the resultant cement structure that is supported by and/or formed around the inner insert 514. The surface 568 may have any desired radius and may extend between the cement surface 560 and the backfill support surface 564. In some embodiments, other edges of the inner insert 514 may have curvature such as, for example, the edge formed at the intersection between ground support surface 562 and backfill support surface 564.

Figure 12B:
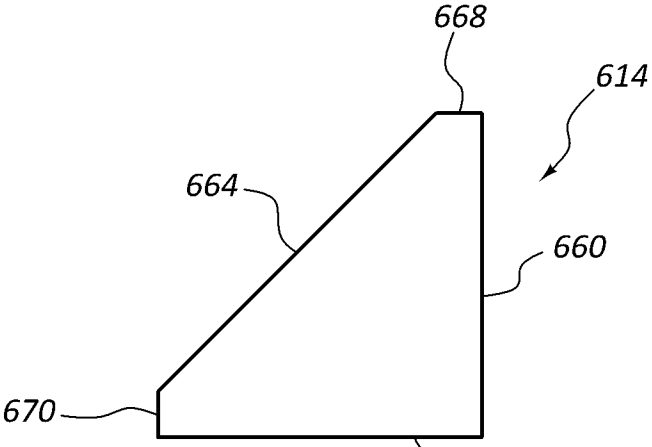

FIG. 12B shows an inner insert 614 having an upper surface 668 defined between the cement surface 660 and the backfill support surface 664, and a planer edge surface 670 defined between the ground support surface 662 and backfill support surface 664. Removing the pointed edges that are otherwise included in place of the surfaces 668, 670 may reduce the propensity of the sharp edges to break off or be deformed/damaged during manufacture, shipping, storage and installation of a cement form assembly at a construction site.

Figure 12C:
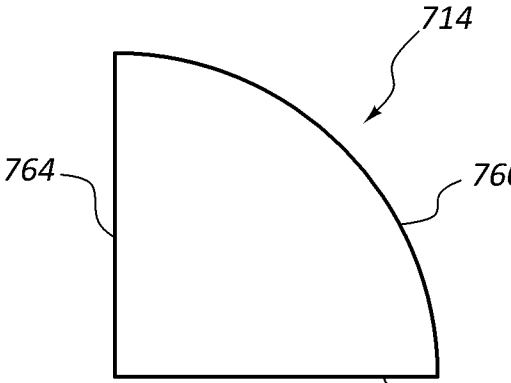

FIG. 12C shows an inner insert 714 having a contoured shape for the cement surface 760. The contoured shape of cement surface 760 may reduce the incidence of stress concentration points at the inner/lower surface of the cement structure (e.g., monolithic foundation). The inner insert 714 may have any desired shape and size for the cement surface 760, including a contoured portion, a combination of linear and contoured portions, and the like. In some embodiments, the backfill support surface 764 may be arranged at a non-vertical orientation thereby reducing the amount of material needed for the inner insert 714. Typically, the ground support surface 762 remains flat or planer to provide a desired interface with the ground support.

Figure 12D:
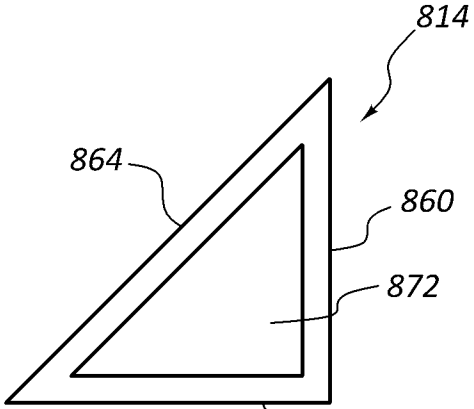

FIG. 12D shows an inner insert 814 having a hollow interior 872. The hollow interior may be formed concurrently with formation of the remaining portions of the inner insert 814. Alternatively, the hollow interior 872 may be formed after formation of the inner insert 814 structure. A boring, cutting, stamping, or other manufacturing step may be used to create the hollow interior 872.

The resulting sidewalls of the inner insert 814 may have a generally constant thickness associated with the cement surface 860, ground support surface 862 and backfill support surface 864. The hollow interior feature may be used in any of the inner insert embodiments shown with reference to FIGS. 12A-12E and other embodiments possible in accordance with the present disclosure. In some arrangements, the hollow interior 872 mirrors the outer peripheral shape cross-sectional shape of the inner insert 814. In other embodiments, the hollow interior may have a shape that is different from the perimeter shape such as, for example, a generally circular shape interior 872 used with the triangular shape outer periphery of inner insert 814.

Figure 12E:
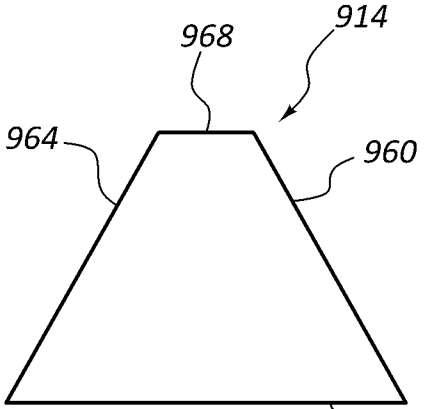

FIG. 12E shows an inner insert embodiment 914 having an equilateral triangular shape with a truncated upper corner of the triangle. The truncated upper portion defines a top surface 968. A top surface 968 may provide the desired improved grading to the top of the inner insert 914 with reduced chance of damaging the top surface 968. The tapered shape of cement surface 960 may provide improved strength and limited stress concentration along the inner, bottom surface of the cement structure (e.g., monolithic foundation). The ground support surface 962 has a generally planer construction. The backfill support surface 964 may mirror the tapered or angled orientation of the cement surface 960. Other variations of the wedge-shaped, triangular-shaped construction of the inner insert 914 are possible wherein different lengths, angled orientations, truncation locations, and the like are provided.

The apparatuses and methods disclosed herein provide numerous advantages as compared to the traditional cement form structures and related methods of forming cement structures such as monolithic cement foundations described above with reference to FIGS. 13A and 13B. For example, the apparatuses and methods disclosed herein provide a reduced cost solution for at least the reason that the required man hours are significantly reduced for setting up cement forms for pouring a cement structure, such as a monolithic cement foundation. Further, the apparatuses and methods disclosed herein provide for improved insulation of a cement structure such as the monolithic cement foundation. The man hours required to install the insulation material is possibly non-existent since the cement forms themselves may include insulating material and be left in the ground after pouring the cement structure and covered to provide the insulating function.

At least some of the methods of manufacturing disclosed herein may provide for improved ease in creating the cement forms. The structure of the cement forms may provide improved storing, shipping, and handling with increased efficiency. Still further, at least some of the materials possible for use in the cement forms (e.g., foam materials) are significantly lighter weight than traditional cement forms. As a result, the cost of shipping and the amount of effort and/or energy required in maneuvering these cement forms of the present disclosure is significantly reduced thereby increasing the overall efficiency for using the cement form assemblies disclosed herein. Further, the use of foam as a primary material for the cement forms provides for a lighter weight object to be manually maneuvered at a work site, which may provide reduced incidence of workplace injuries such as back strains, pulled muscles, foot or leg crushing/bruising, and the like due that may otherwise occur when using traditional material for the cement forms.

Another advantage related to using foam or polymer materials as the primary (if not exclusive) material for the cement form is that such materials typically do not absorb moisture from the cement as the cement cures. Avoiding moisture absorption leads to improved consistency in how the cement cures as compared to using other materials for the cement forms such as wood. Wood cement forms have a high rate of moisture absorption and are typically sprayed with a petroleum product such as diesel fuel just prior to pouring the cement in an effort to limit the moisture absorption properties of the wood. An improved consistency in how the cement cures may lead to reduced incidence of later cracking in the cement structure.

A further advantage relates to the ability to backfill around and/or over the cement forms prior to pouring cement. The pre-backfilling (i.e., prior to pouring cement) makes it possible to have excavation equipment on site just for digging and set up of the cement forms (i.e., the equipment does not have to return after pouring cement and removing the cement forms according to traditional methods), thereby decreasing costs and overall time for completing formation of a cement structure such as a monolithic foundation. Increasing the speed of forming a cement foundation typically results in an over decrease in the overall time for completion of a construction project, which leads to reduced costs and improved efficiencies. Providing a backfill prior to pouring also may involve grading the ground surface surrounding the cement forms. A graded surface may improve safety for workers during pouring of cement because the workers can work on a graded rather than having to work on uneven surface and/or working around kickers, stakes and brace boards as is required in traditional methods.

The present description provides examples, and is not limiting of the scope, applicability, or configuration set forth in the claims. Thus, it will be understood that changes may be made in the function and arrangement of elements discussed without departing from the spirit and scope of the disclosure, and various embodiments may omit, substitute, or add other procedures or components as appropriate. For instance, the methods described may be performed in an order different from that described, and various steps may be added, omitted, or combined. Also, features described with respect to certain embodiments may be combined in other embodiments.

Various inventions have been described herein with reference to certain specific embodiments and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including:" and "having" come as used in the specification and claims shall have the same meaning as the term "comprising."

INCORPORATION BY REFERENCE

The entire content of each document listed below is incorporated by reference into this document (the documents below are collectively referred to as the "incorporated documents"). If the same term is used in both this document and one or more of the incorporated documents, then it should be interpreted to have the broadest meaning imparted by any one or combination of these sources unless the term has been explicitly defined to have a different meaning in this document. If there is an inconsistency between any incorporated document and this document, then this document shall govern. The incorporated subject matter should not be used to limit or narrow the scope of the explicitly recited or depicted subject matter.

Priority patent documents incorporated by reference:

U.S. Pat. Pub. No. 2020/0115878 (application. Ser. No. 16/713,517), titled "Cement Form Apparatus and Method," filed on 13 Dec. 2019, published on 16 Apr. 2020.

U.S. Pat. No. 10,538,893 (application. Ser. No. 15/967,259), titled "Cement Form Apparatus and Method," filed on 30 Apr. 2018, issued on 21 Jan. 2020.

U.S. Pat. No. 10,024,023 (application. Ser. No. 14/698,674), titled "Cement Form Apparatus and Method," filed on 28 Apr. 2015, issued on 17 Jul. 2018.

The invention claimed is:

1. A structure comprising backfill and a cement form that comprises:

a first portion defining a ground facing surface that extends horizontally and that contacts a ground surface;

a second portion defining a cement facing surface that extends upward from the first portion and that is configured to contact, support, and form a volume of cement that is poured into the structure; and an intermediate portion defining an inclined surface extending upward: (i) at an angle relative to the ground facing surface and the cement facing surface and (ii) in a direction from the ground facing surface towards the cement facing surface, wherein the ground facing surface, the cement facing surface, and the inclined surface define at least a substantially triangular cross-section of the structure along an entire length of the structure;

wherein:

at least a portion of the cement form is covered by the backfill; and the cement form includes a foam material.

2. The structure of claim 1 wherein the intermediate portion is a brace portion extending between the first portion and the second portion to support the first portion in an upright position.

3. The structure of claim 1 wherein the intermediate portion is a support rib extending between the first portion and the second portion to support the first portion in an upright position.

4. The structure of claim 1 wherein the intermediate portion includes a weight bearing portion extending between the first portion and the second portion.

5. The structure of claim 1 wherein the cement form has an elongated shape.

6. The structure of claim 1 wherein the first portion, the second portion, and the intermediate portion have a solid construction consisting essentially of the foam material.

7. The structure of claim 1 wherein the ground facing surface and the cement facing surface are planar.

8. The structure of claim 1, wherein:

the ground facing surface is a first ground facing surface and the cement facing surface is a first cement facing surface;

the structure comprises an inner insert comprising (1) a second ground facing surface that extends horizontally and that is configured to contact the ground surface and (2) a second cement facing surface that extends upward from the second ground facing surface and that is configured to contact and support the volume of cement; and the inner insert is not an integral part of the cement form.

9. The structure of claim 1 wherein the cement form has a length, width, and height, the length being measured along the cement facing surface in a horizontal direction, the width being measured along the ground facing surface in a direction perpendicular to the length, and the height being measured from the ground facing surface to an upper most edge of the cement facing surface; wherein the length is greater than the width and the height.

10. The structure of claim 9, wherein:

the height is at least 12 inches and up to 24 inches; and the width is at least 12 inches and up to 24 inches.

11. The structure of claim 9, comprising the volume of cement, wherein:

the height is at least 12 inches and up to 24 inches;

the width is at least 12 inches and up to 24 inches; and the form insulates the volume of cement.

12. The structure of claim 1 further comprising a minimum thickness measured from the ground facing surface or from the cement facing surface, the minimum thickness being at least 2 inches.

13. The structure of claim 1, comprising a plurality of cement forms and a connecting member, wherein:

the plurality of cement forms comprise the cement form; and each cement form of the plurality of cement forms is coupled together and aligned with the connecting member.

14. The structure of claim 1, comprising the volume of cement, wherein the form insulates the volume of cement.

15. A cement building foundation comprising a cement foundation of a building, backfill, and a cement form, wherein:

the cement form comprises (1) a ground facing surface that extends horizontally on a ground surface, (2) a cement facing surface that extends upward from the ground facing surface, and (3) an inclined surface extending upward at an angle relative to the ground facing surface and the cement facing surface, wherein the ground facing surface, the cement facing surface, and the inclined surface define at least a substantially triangular cross-section of the cement form along an entire length of the cement form;

the cement facing surface contacts the cement foundation;

at least a portion of the cement form is covered with the backfill;

the ground facing surface and the cement facing surface meet at a corner; and the cement form includes a foam material.

16. The cement building foundation of claim 15 wherein the inclined surface extending upward in a direction from the ground facing surface towards the cement facing surface.

17. The cement building foundation of claim 16 wherein at least a portion of the inclined surface is covered by the backfill.

18. The cement building foundation of claim 16 wherein the inclined surface is positioned on a side of the cement form opposite the corner where the ground facing surface and the cement facing surface meet.

19. The cement building foundation of claim 16 comprising:

a first portion extending horizontally along the ground surface and including the ground facing surface; and a second portion extending upward from the first portion and including the cement facing surface;

wherein the inclined surface is defined at least in part by a brace portion extending between the first portion and the second portion to support the first portion in an upright position.

20. The cement building foundation of claim 16 comprising:

a first portion extending horizontally along the ground surface and including the ground facing surface; and a second portion extending upward from the first portion and including the cement facing surface;

wherein the inclined surface is defined at least in part by a support rib extending between the first portion and the second portion to support the first portion in an upright position.

21. The cement building foundation of claim 16 comprising:

a first portion extending horizontally along the ground surface and including the ground facing surface; and a second portion extending upward from the first portion and including the cement facing surface;

wherein the inclined surface is defined at least in part by a weight bearing portion extending between the first portion and the second portion.

22. The cement building foundation of claim 15 comprising a plurality of cement forms coupled together and aligned with a connecting member.

23. The cement building foundation of claim 15 wherein the ground facing surface is a first ground facing surface and the cement facing surface is a first cement facing surface, the cement building foundation comprising:

an inner insert spaced apart from the cement form, the inner insert comprising:

a second ground facing surface extending horizontally on the ground surface; and a second cement facing surface extending upward from the second ground facing surface, the second cement facing surface contacting the cement foundation.

* * * * *